US011177096B2

(12) United States Patent
Shibuya

(10) Patent No.: US 11,177,096 B2
(45) Date of Patent: Nov. 16, 2021

(54) MULTIFUNCTION SWITCH

(71) Applicant: MIYAMA ELECTRIC CO., LTD., Tokyo (JP)

(72) Inventor: Tomochika Shibuya, Tokyo (JP)

(73) Assignee: MIYAMA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/681,811

(22) Filed: Nov. 12, 2019

(65) Prior Publication Data

US 2020/0176203 A1 Jun. 4, 2020

(30) Foreign Application Priority Data

Nov. 29, 2018 (JP) ..... JP2018-223421

(51) Int. Cl.
*H01H 25/04* (2006.01)
*H01H 23/16* (2006.01)

(52) U.S. Cl.
CPC ..... *H01H 25/041* (2013.01); *H01H 23/16* (2013.01); *H01H 2025/043* (2013.01)

(58) Field of Classification Search
CPC ..... H01H 25/041; H01H 25/04; H01H 2025/043; H01H 23/205
See application file for complete search history.

(56) References Cited

U.S. PATENT DOCUMENTS 4,215,257 A 7/1980 Repplinger
6,762,372 B2 * 7/2004 Nishimoto ..... H01H 25/041 200/18
6,812,415 B1 * 11/2004 Priesemuth ..... H01H 3/20 200/5 R
9,793,074 B2 * 10/2017 Yamanaka ..... H01H 25/006
2005/0082155 A1 4/2005 Sasaki
2012/0152052 A1 * 6/2012 Suzuki ..... H01H 3/50 74/504

FOREIGN PATENT DOCUMENTS

GB 527308 4/1939
JP S51-52459 11/1977
JP H087704 A 1/1996
JP H10247441 A 9/1998

OTHER PUBLICATIONS

Japanese Patent Office (JPO), Machine Translation of Japanese Office Action and corresponding Japanese Office Action for Japanese Patent Application 2018-223421, dated Sep. 17, 2019, Japan.
Office Action from German Patent Office, dated Jul. 1, 2020.
English Translation of Office Action from German Patent Office, dated Jul. 1, 2020.

* cited by examiner

*Primary Examiner* — Felix O Figueroa
(74) *Attorney, Agent, or Firm* — Steven M. Greenberg, Esq.; Shutts & Bowen LLP

(57) ABSTRACT

A multifunction switch has a switching function for an electrical contact switch and a switching function for a mechanical element. The multifunction switch includes a swingable control body having a control pin, a movable contact coming into contact with the control pin, and a movable element having the control pin running therethrough and supported so as to be swingable. With the control pin being swung, the movable contact is pressed by the control pin to come into contact with a fixed contact and the movable element is swung by the control pin to implement mechanical switching for an additional element.

9 Claims, 37 Drawing Sheets

MULTIFUNCTION SWITCH

CROSS-REFERENCE TO RELATED APPLICATION

This application claims the benefit of priority to Japanese Patent Application No. 2018-223421 filed on 29 Nov. 2018, the disclosures of all of which are hereby incorporated by reference in their entireties.

TECHNICAL FIELD

The present invention relates to a multifunction switch.

BACKGROUND ART

A switch of a related art includes a swingable pusher, a swinging contact plate to be swung by the pusher, and a fixed contact to contact the swinging contact plate in a swung state (see Japanese Patent Application Publication No. H10-247441).

SUMMARY OF THE INVENTION

Problems to be Solved

The above-described switch only serves as an electrical contact switch and does not have a switching function for an additional mechanical element. Accordingly, when a switching function for the mechanical element is added to the switch, the switch requires other parts to end up having more parts and more complicated structure, and accordingly increased costs.

The present invention is intended to provide a multifunction switch having a switching function for an electrical contact switch and a switching function for a mechanical element.

Solution to Problems

A multifunction switch is provided to achieve the above-identified objective and includes a swingable control body having a control pin, a movable contact coming into contact with the control pin, and a movable element having the control pin running therethrough and swingably supported. With the control pin being swung, the movable contact is pressed by the control pin to come into contact with a fixed contact and the movable element is swung by the control pin to implement mechanical switching for a target element.

Advantageous Effects of the Invention

With use of the present invention, the movable contact and the fixed contact implement switching for an electrical contact switch and the movable element is swung to implement switching for the target element, for example. The movable element is incorporated into the swinging switch to have a simple and inexpensive configuration with a small number of parts.

DETAILED DESCRIPTION OF EMBODIMENTS

First Embodiment

Hereinafter, embodiments of the present invention will be described with reference to the drawings. A multifunction switch 1 includes a swingable control body 20, a contact circuit 30 electrically connectable by the control body 20, and a movable mechanism 40 operable by the control body 20, as shown in FIGS. 1 and 4.

Figure 1:
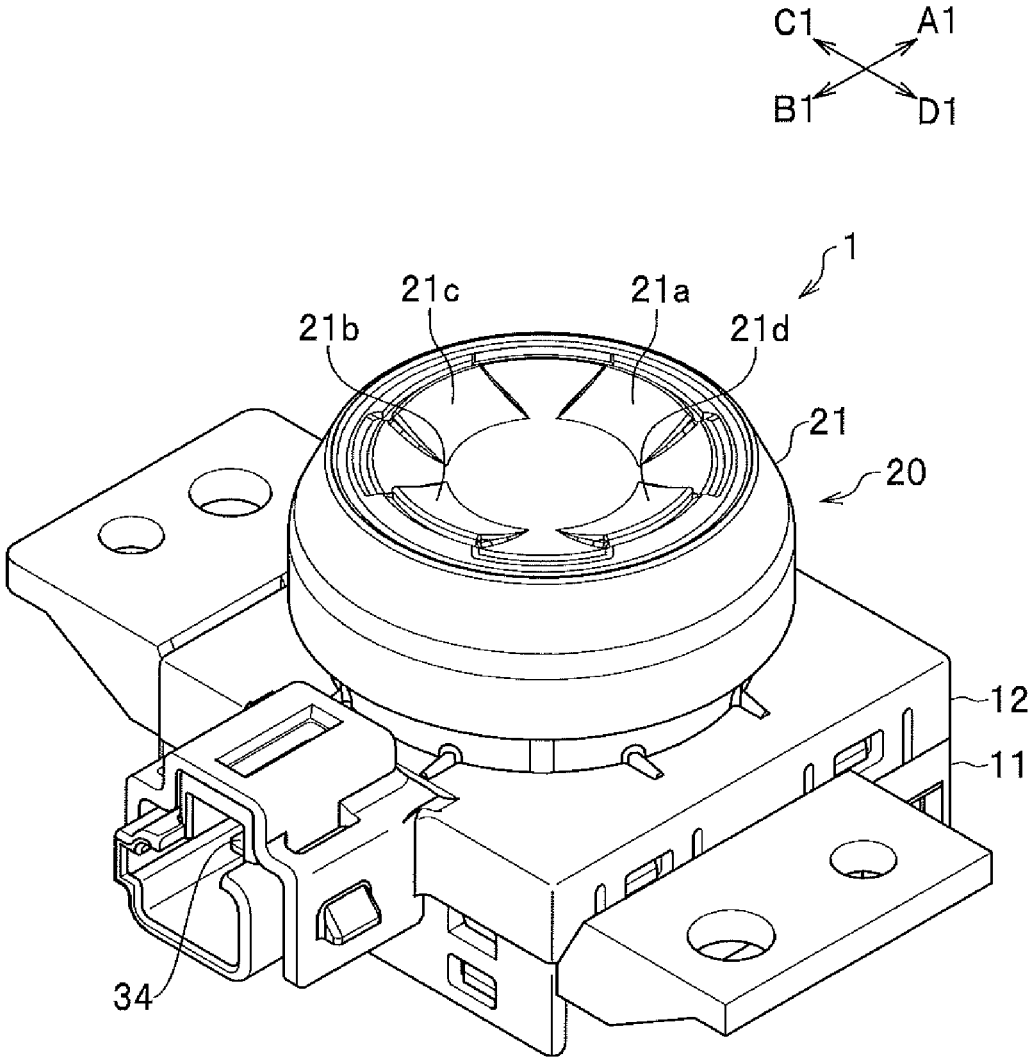
FIG. 1 is a perspective view of a multifunction switch of a first embodiment.
Figure 2A:
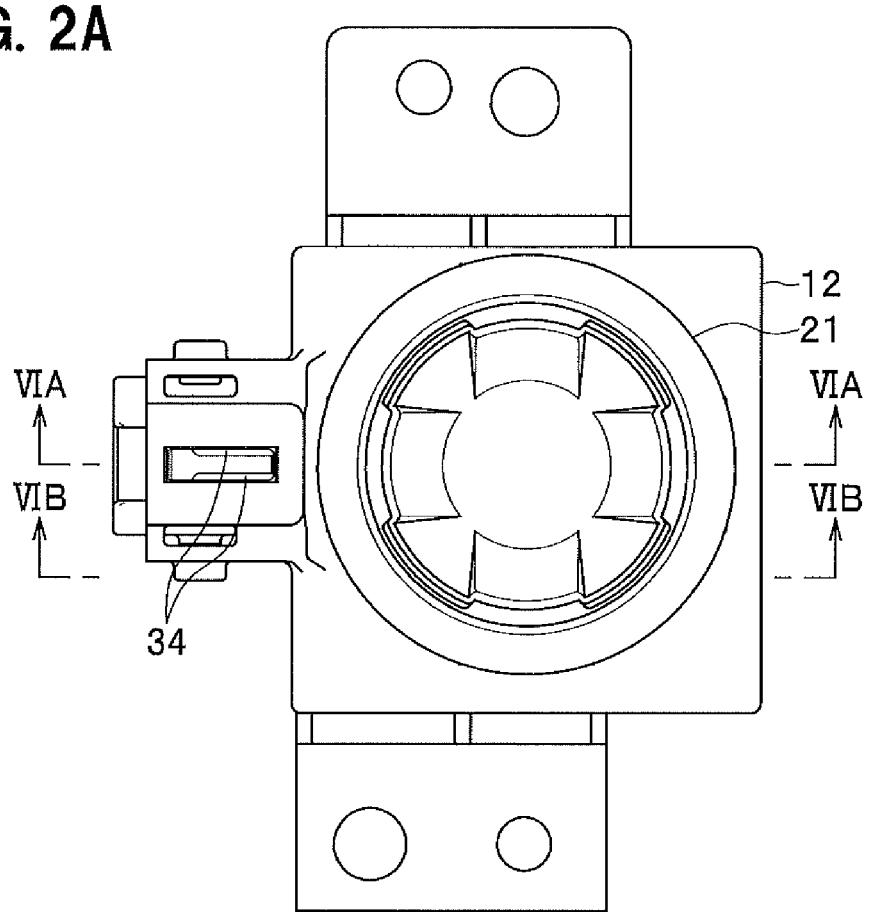
FIG. 2A is a plan view of the multifunction switch shown in FIG. 1.
Figure 2B:
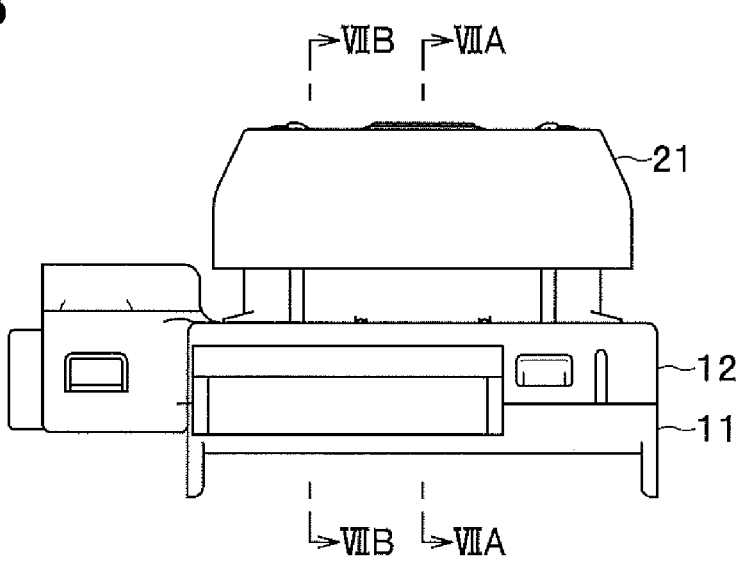
FIG. 2B is a side view of the multifunction switch shown in FIG. 1.

The multifunction switch 1 includes a basal plate 11 and a case 12 attached to the basal plate 11, as shown in FIG. 1.

Figure 4:
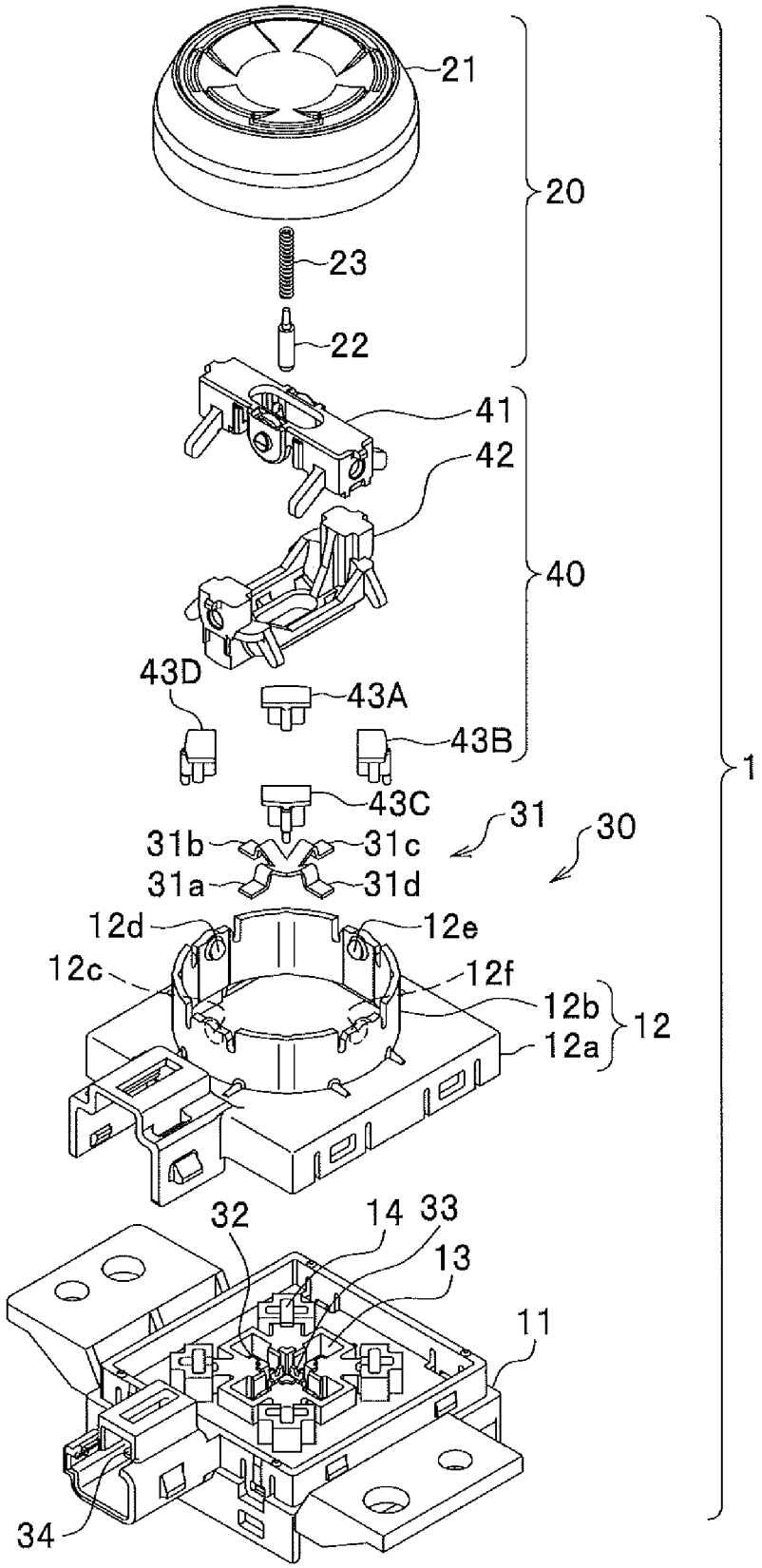
FIG. 4 is an exploded perspective view of the multifunction switch in FIG. 1.
Figure 5A:
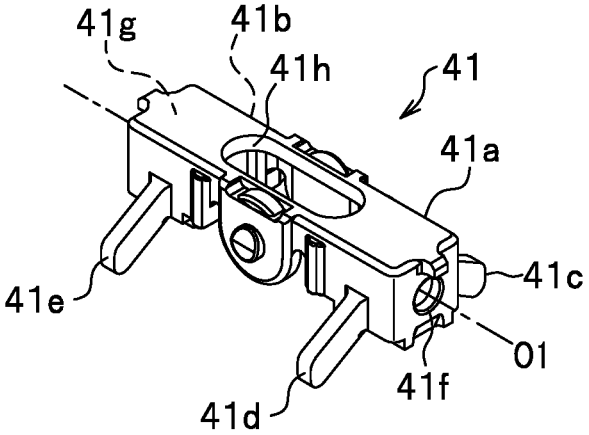
FIG. 5A is an enlarged perspective view of a first movable element in FIG. 4.
Figure 5B:
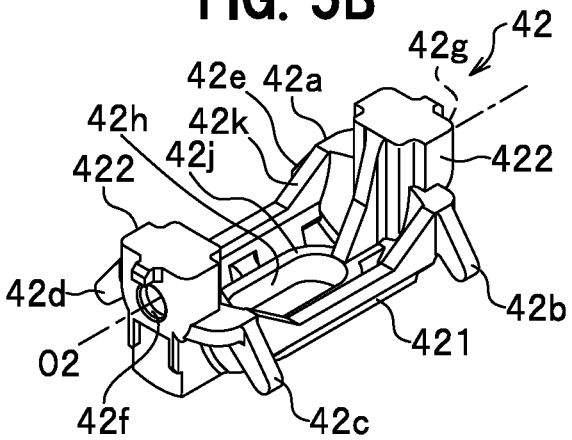
FIG. 5B is an enlarged perspective view of a second movable element in FIG. 4.
Figure 5C:
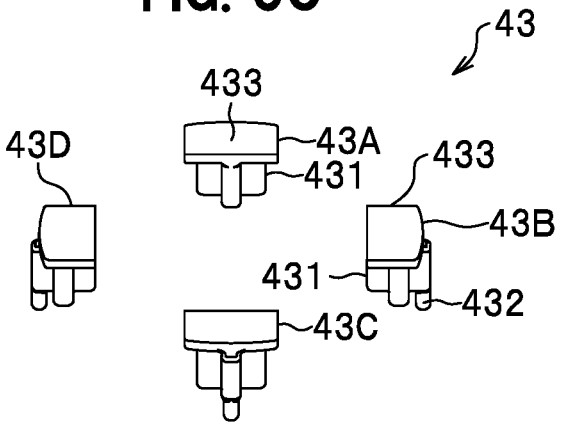
FIG. 5C is an enlarged perspective view of a slider in FIG. 4.

The basal plate 11 includes a contact receiver 13 protruding from a center portion thereof and a slider guide 14 disposed outside the contact receiver 13, as shown in FIG. 4. The contact receiver 13 includes a center recess 13*a* and outer recesses 13*b*, 13*c*, 13*d*, and 13*e* extending outward from the center recess 13*a*, as shown in FIG. 5E. The outer recesses 13*b* to 13*e* are arranged at intervals of an angle of 90 degrees about the center recess 13*a*. The slider guide 14 includes cross-shaped guide holes 14*a*, 14*b*, 14*c*, and 14*d* disposed between adjacent pairs of the outer recesses 13*b* to 13*e*.

The case 12 includes a rectangular base case 12*a*, a cylindrical case 12*b* protruding from the center of the base case 12*a*, and support spindles 12*c*, 12*d*, 12*e*, and 12*f* arranged on an inner peripheral surface of the cylindrical case 12*b* at intervals of an angle of 90 degrees about the axis of the cylindrical case, as shown in FIG. 4.

The control body 20 includes a circular control cap 21 controllable in four directions, a control pin 22 suspended from the center of the control cap 21, and a coil spring 23 attached to a base end of the control pin 22. The control cap 21 has a cylindrical portion 211 at the inner center (see FIG. 6A). The cylindrical portion 211 has the control pin 22 inserted thereinto along with a coil spring 23.

In FIG. 4, the contact circuit 30 includes a movable contact 31, a fixed contact 32 paired with the movable contact 31, a fulcrum member 33 (see FIG. 5E) made of an electric conductor for supporting the movable contact 31, and a terminal 34 electrically connected with the fixed contact 32 and the fulcrum member 33.

Figure 3A:
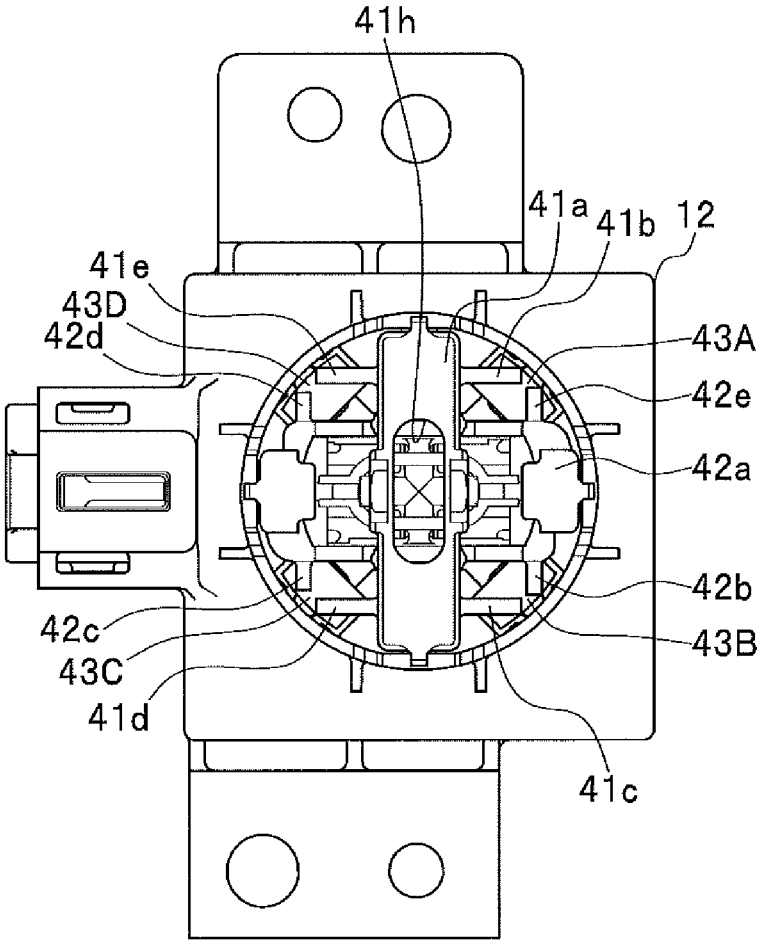
FIG. 3A is a partially-exploded plan view of the multifunction switch in FIG. 1.
Figure 3B:
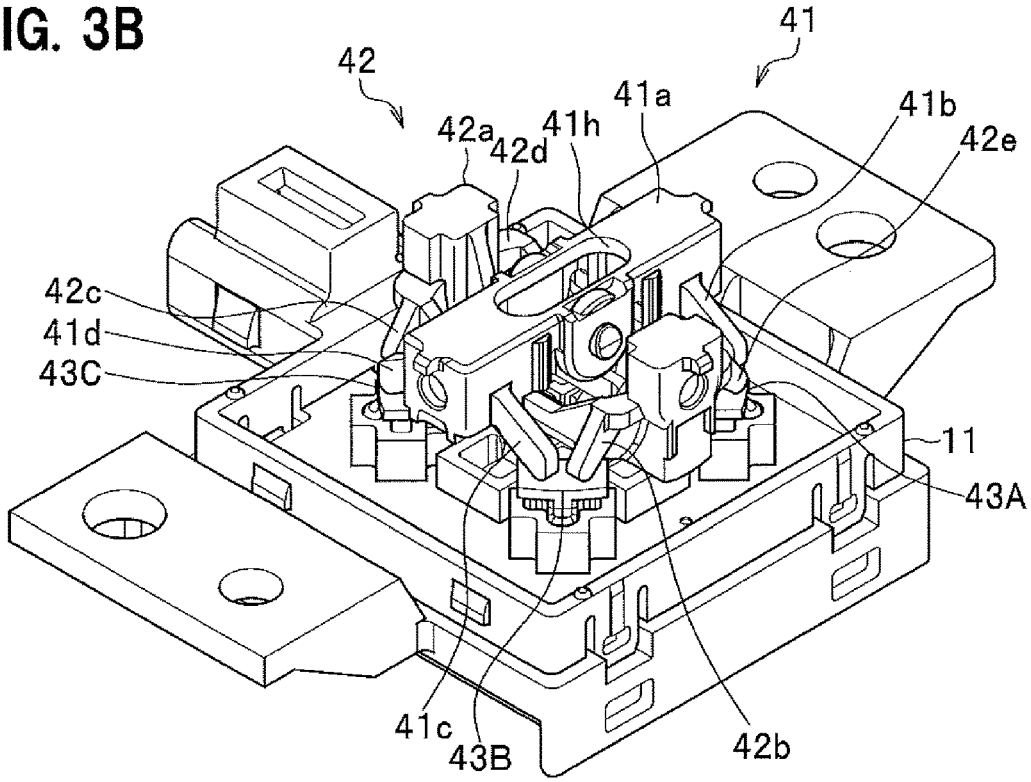
FIG. 3B is a partially-exploded perspective view of the multifunction switch in FIG. 1.
Figure 3C:
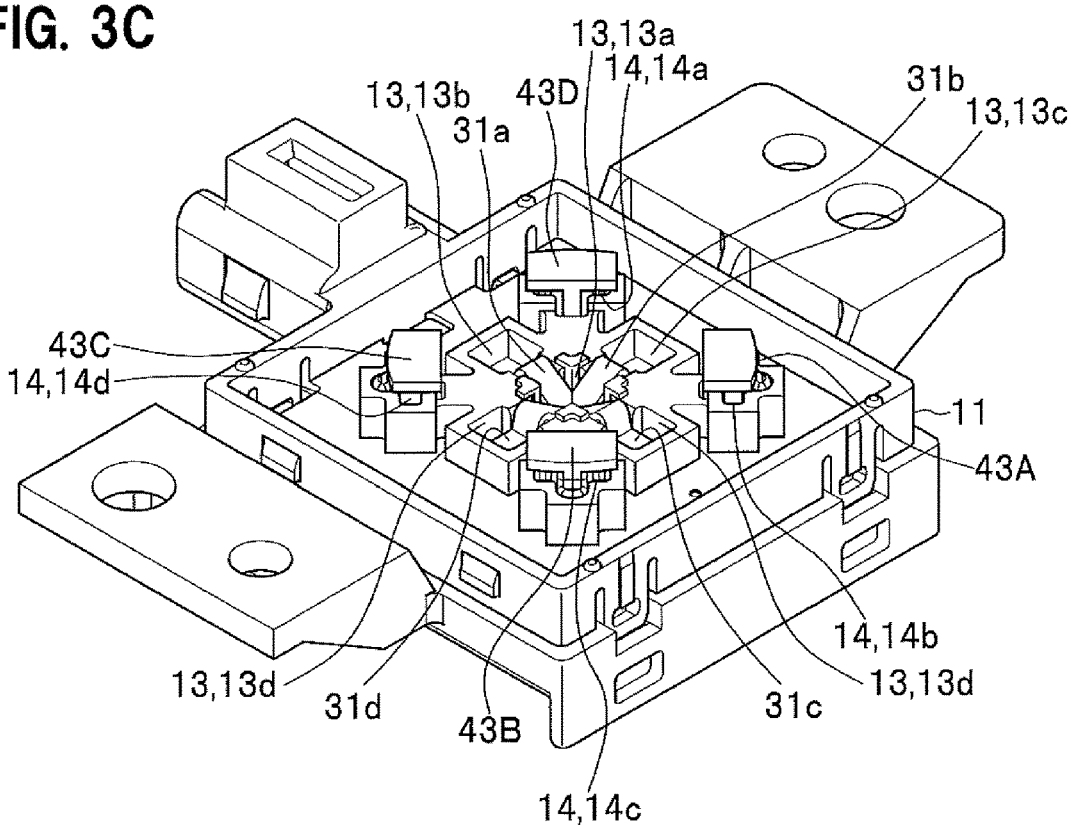
FIG. 3C is a partially-exploded perspective view of the multifunction switch in FIG. 1.
Figure 5D:
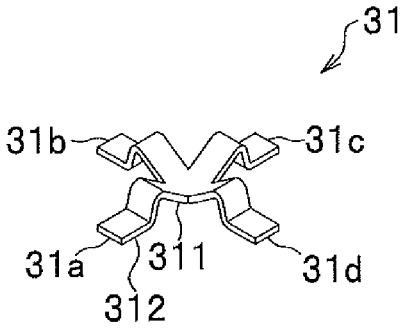
FIG. 5D is an enlarged perspective view of a movable contact in FIG. 4.
Figure 5E:
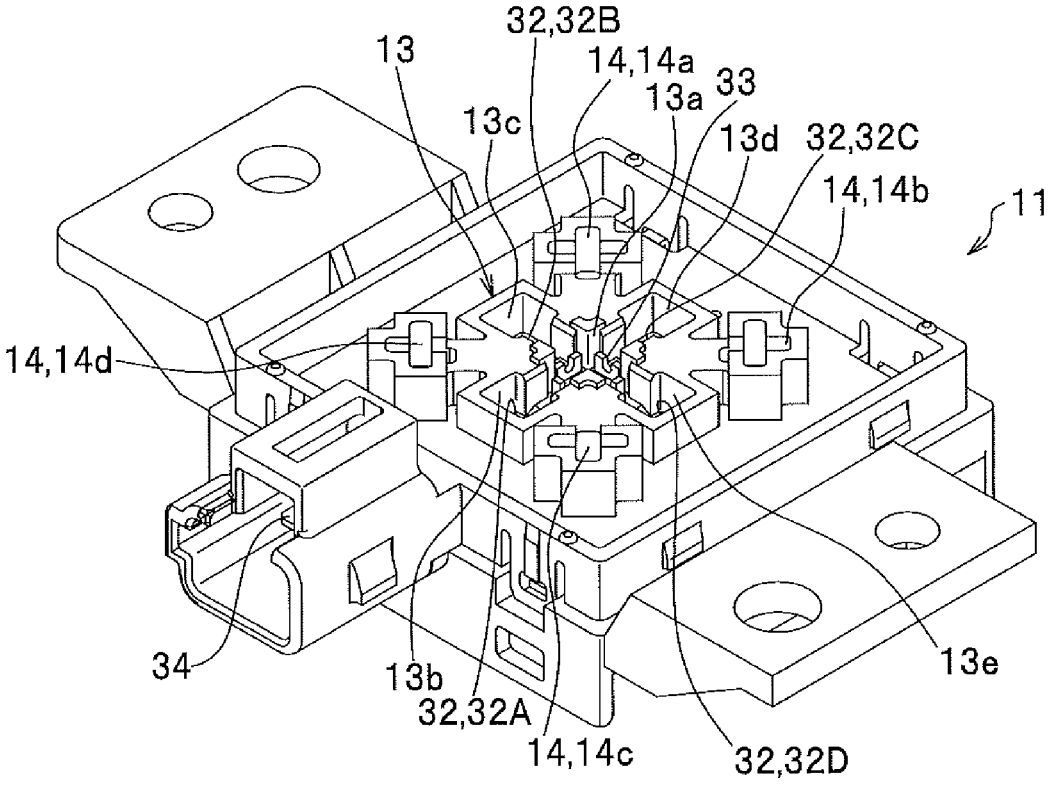
FIG. 5E is an enlarged perspective view of a basal plate in FIG. 4.

The movable contact 31 has integrally-formed movable contact plates 31*a*, 31*b*, 31*c* and 31*d*, as shown in FIG. 5D. The movable contact plates 31*a* to 31*d* extend radially from the center at intervals of an angle of 90 degrees. The movable contact plates 31*a* to 31*d* each have a swinging portion 311 extending upward, and a contact portion 312 extending downward from a top edge of the swinging portion 311 and then extending horizontally. As shown in FIG. 3C, the cross-shaped movable contact 31 is received in the contact receiver 13. The movable contact plates 31*a* to 31*d* are disposed so as to extend from the center recess 13*a* to the outer recesses 13*b* to 13*e*, respectively. Note that the movable contact 31 may include two movable contact plates of the movable contact plates 31*a* to 31*d*, crossing each other, depending on the number of fixed contacts, such as the movable contact plates 31*a* and 31*b*, or the movable contact plates 31*a* and 31*d*. Alternatively, the movable contact 31 may include three movable contact plates crossing each other, such as the movable contact plates 31*a*, 31*b*, 31*c*, or the movable contact plates 31*a*, 31*c*, 31*d*. Each of the movable contact plates 31*a* to 31*d* respectively corresponds to the first or second contact plate of the present invention.

The fixed contact 32 includes fixed contacts 32A, 32B, 32C, and 32D, as shown in FIG. 5E. The fixed contacts 32A to 32D are disposed in the outer recesses 13*b* to 13*e*, respectively.

The fulcrum member 33 is disposed in the central recess 13*a*, as shown in FIG. 5E. The fulcrum member 33 includes a base plate 33*a* (see FIGS. 6A and 7A) and fulcrum plates 33*b*, 33*c*, 33*d*, and 33*e* in a concave shape extending upward from the base plate 33*a* toward the control body 20. The base plate 33*a* is disposed in the center recess 13*a*. The fulcrum plates 33*b* to 33*e* are respectively disposed at the boundaries between the central recess 13*a* and the outer recesses 13*b* to 13*e*, to support the movable contact plates 31*a* to 31*d*.

The terminal 34 includes a terminal electrically connected to the movable contact 31 via the fulcrum member 33 and a terminal connected to the fixed contact 32. The terminal 34 is electrically connected to an external electrical device, such as an electrical component of an automobile.

The movable mechanism 40 includes a first movable element 41, a second movable element 42 disposed so as to (orthogonally) cross the first movable element 41, and sliders 43A, 43B, 43C, 43D moved by the first movable element 41 and the second movable element 42, as shown in FIG. 4.

Figure 6A:
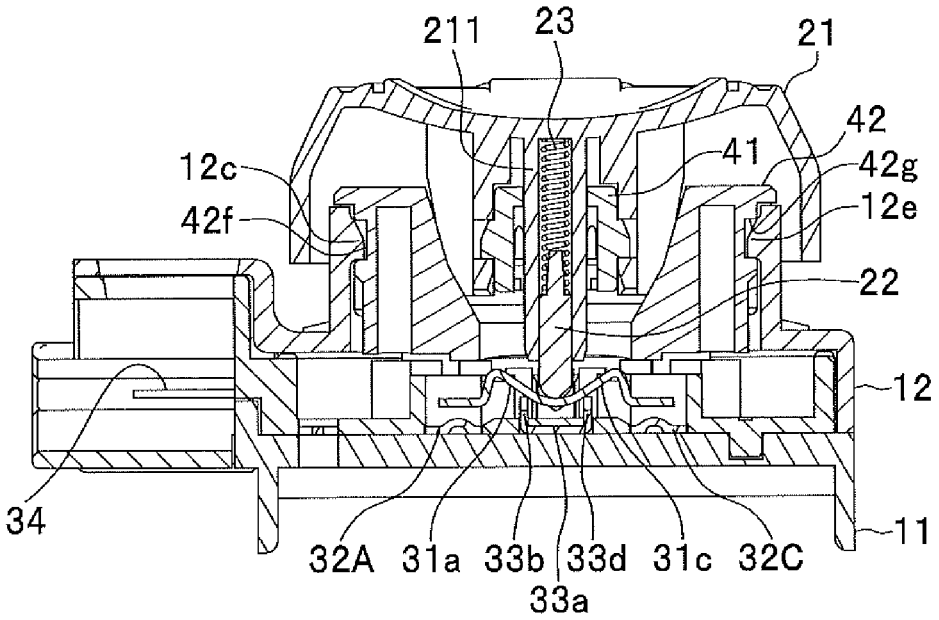
FIG. 6A is a cross-sectional view taken along a line VIA-VIA in FIG. 2.
Figure 6B:
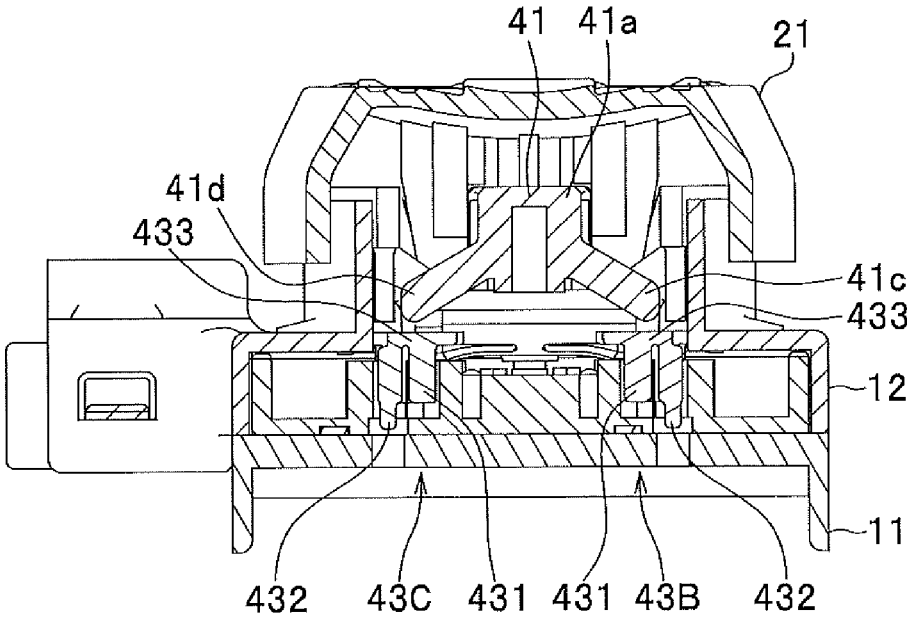
FIG. 6B is a cross-sectional view taken along a line VIB-VIB in FIG. 2.

The first movable element 41 includes a body portion 41*a* having a hollow portion, and leg portions 41*b*, 41*c*, 41*d*, and 41*e* disposed at both ends in the longitudinal direction of the body portion 41*a*, as shown in FIG. 5A. The leg portions 41*b* and 41*c* extend obliquely downward from one side surface of the body portion 41*a*. The leg portions 41*d* and 41*e* extend obliquely downward from the opposite side surface of the body portion 42*a*. With reference to FIGS. 6A and 6B, the leg portions 41*b* and 41*c* are arranged on the opposite side from the movable contact plate 31*a* with respect to the control pin 22. The leg portions 41*d* and 41*e* are arranged on the opposite side from the movable contact plate 31*c* with respect to the control pin 22.

Figure 7A:
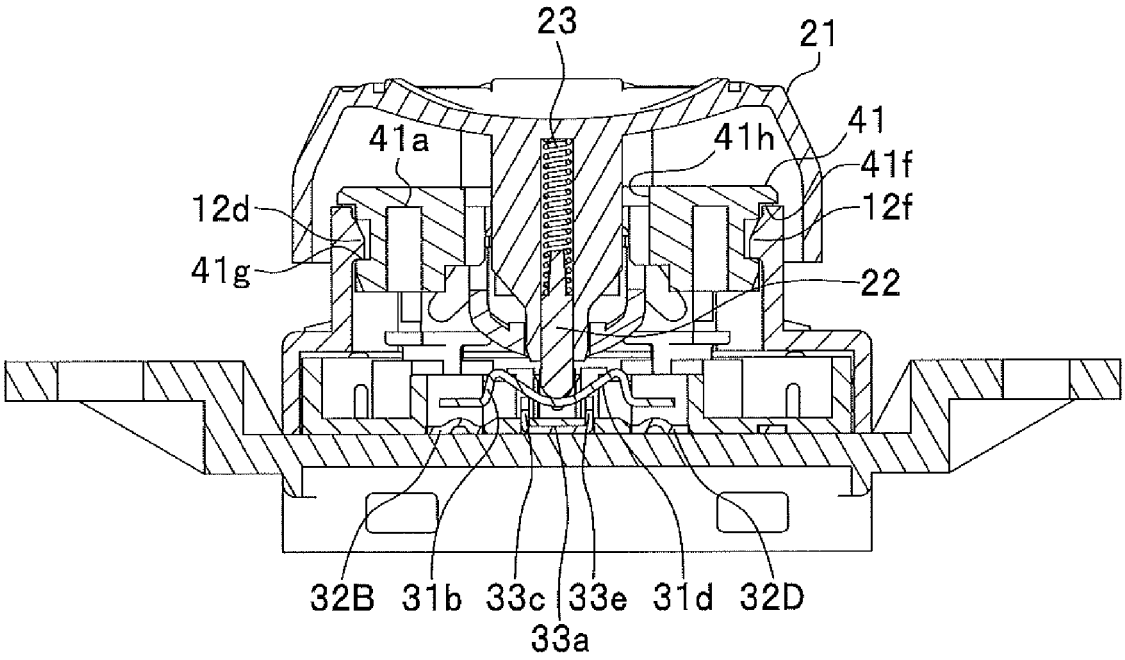
FIG. 7A is a cross-sectional view taken along a line VIIA-VIIA in FIG. 2.

In FIG. 5A, the body portion 41*a* has support holes 41*f* and 41*g* in both end faces in the longitudinal direction thereof. The support spindles 12*d* and 12*f* of the case 12 are inserted into the respective support holes 41*f* and 41*g*, as shown in FIG. 7A. This makes the first movable element 41 supported by the case 12 so as to be swingable about an axis O1 running through the support holes 41*f* and 41*g*.

In FIG. 5A, the body portion 41*a* has, in an upper surface thereof, a longitudinally-extending guide hole 41*h*. The guide hole 41*h* guides the control pin 22 to be moved in the longitudinal direction of the body portion 41*a*.

Figure 7B:
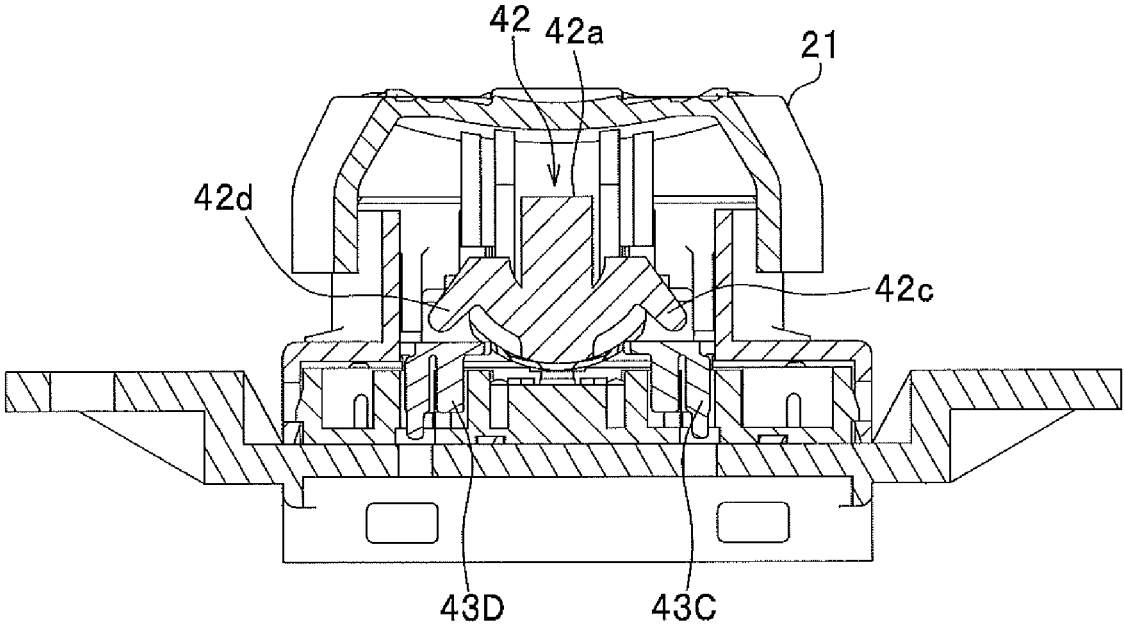
FIG. 7B is a cross-sectional view taken along a line VIIB-VIIB in FIG. 2.

The second movable element 42 includes a body portion 42*a* in a concave shape and leg portions 42*b*, 42*c*, 42*d*, and 42*e* disposed at both ends in the longitudinal direction of the body portion 42*a*, as shown in FIG. 5B. The body portion 42*a* includes a bottom portion 421 and support portions 422 protruding from both ends in the longitudinal direction of the bottom portion 421. The leg portions 42*b* and 42*c* extend obliquely downward from one side surface of the bottom portion 421. The leg portions 42*d* and 42*e* extend obliquely downward from the opposite side surface of the bottom portion 421. With reference to FIGS. 7A and 7B, the leg portions 42*b* and 42*c* are disposed on the opposite side from the movable contact plate 31*b* with respect to the control pin 22. The leg portions 42*d* and 42*e* are disposed on the opposite side from the movable contact plate 31*d* with respect to the control pin 22.

In FIG. 5B, the body portion 42*a* has support holes 42*f* and 42*g* in the support portion 422 (see FIG. 6A). The support spindles 12*c* and 12*e* of the case 12 are inserted into the respective support holes 42*f* and 42*g*. This makes the second movable element 42 supported by the case 12 so as to be swingable about an axis 02 running through the support holes 42*f* and 42*g*.

In FIG. 5B, the body portion 42*a* has a frame portion 42*j* that is supported by a vicinity of an opening in the bottom portion 421 and defines a longitudinally-extending guide hole 42*h*. The guide hole 42*h* is arranged so as to partially coincide with the guide hole 41*h* in a top view (see FIG. 3A). The guide hole 42*h* guides the control pin 22 to be moved in the longitudinal direction of the body portion 42*a*. The body portion 42*a* has a recess 42*k* defined by the bottom portion 421 and the support portion 422, and the body portion 41*a* of the first movable element 41 is disposed in the recess 42*k* (see FIG. 3B).

The sliders 43A to 43D each include a cross-shaped slide portion 431, a protrusion 432 extending from a front end of the slide portion 431, and a stopper 433 formed perpendicular to a base end of the slide portion 431, as shown in FIG. 5C. The sliders 43A to 43D are inserted into the respective guide holes 14*a* to 14*d*, as shown in FIG. 3C, and are vertically and lineally movable in the respective guide holes 14*a* to 14*d*. As shown in FIG. 3A, the slider 43A is associated with the leg portions 41*b* and 42*e*. The slider 43B is associated with the leg portions 41*c* and 42*b*. The slider 43C is associated with the leg portions 41*d* and 42*c*. The slider 43D is associated with the leg portions 41*e* and 42*d*. The sliders 43A to 43D collectively serve as a selector switch for an additional mechanical element disposed under the basal plate 11. The sliders 43A to 43D are used for mechanically switching a flow path valve or pressing respective buttons, for example. Note that biasing means to bias the sliders 43A to 43D upward may be provided in the present embodiment.

Next, operation of the multifunction switch 1 is described. As shown in FIG. 1, the multifunction switch 1 is designed such that pressing a portion 21*a*, 21*b*, 21*c*, or 21*d* of the control cap 21 downward allows for switching four contact points and switching four modes of the movable mechanism 40. In other words, the multifunction switch 1 implements 4-way switching for an electrical device and 4-way switching for an mechanical element. Hereinafter, a description is given in detail of the operation of the multifunction switch 1 in cases where the respective portions 21*a* to 21*d* are pressed.

Figure 8A:
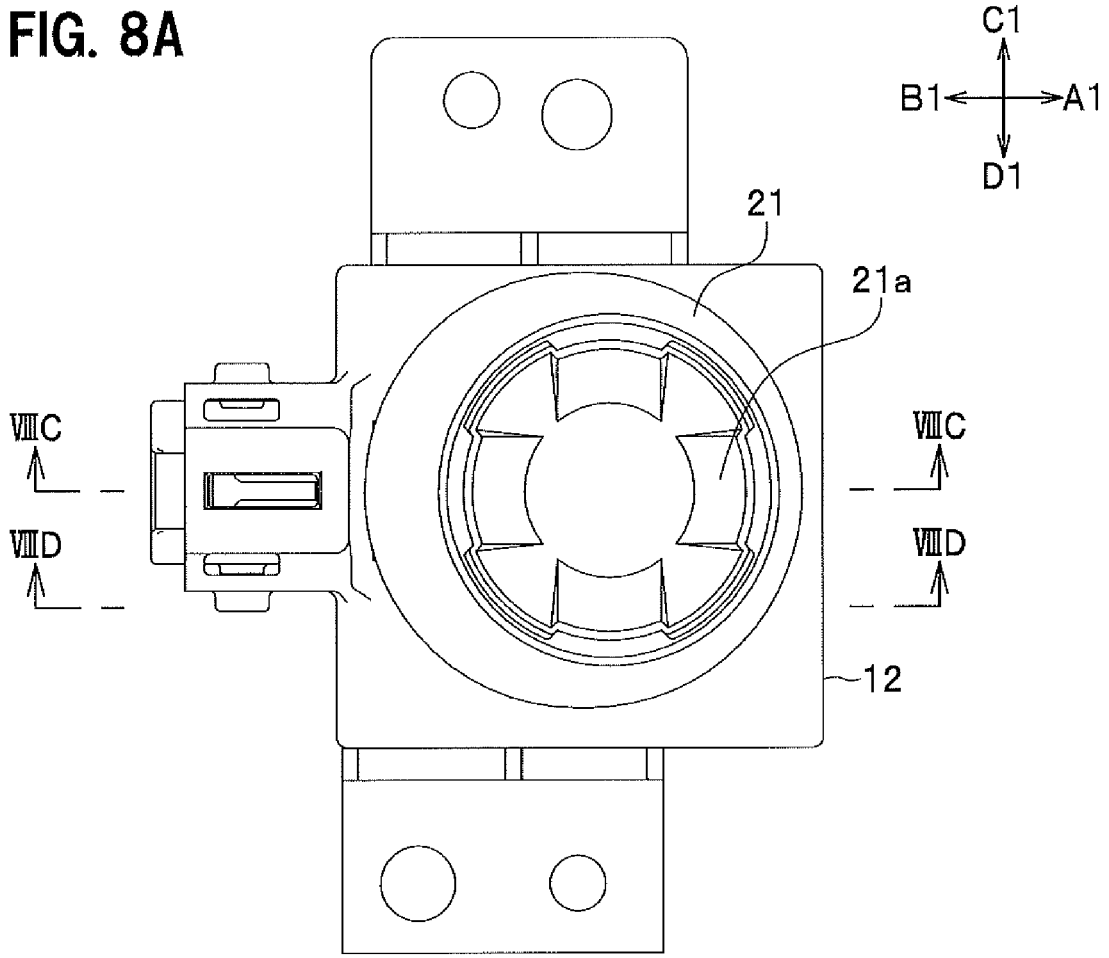
FIG. 8A is a plan view of the multifunction switch having a control cap swung toward a direction indicated by A1.
Figure 8B:
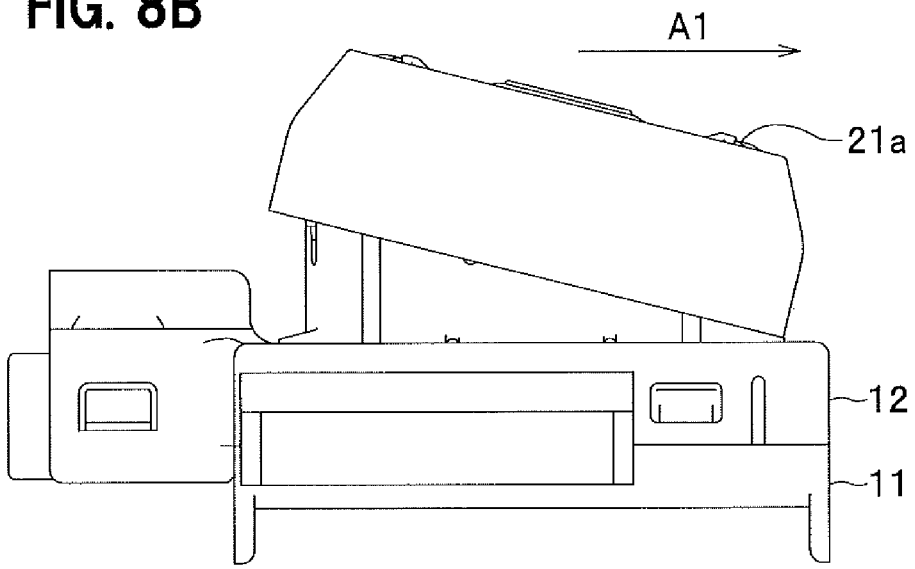
FIG. 8B is a side view of the multifunction switch in FIG. 8A.
Figure 8C:
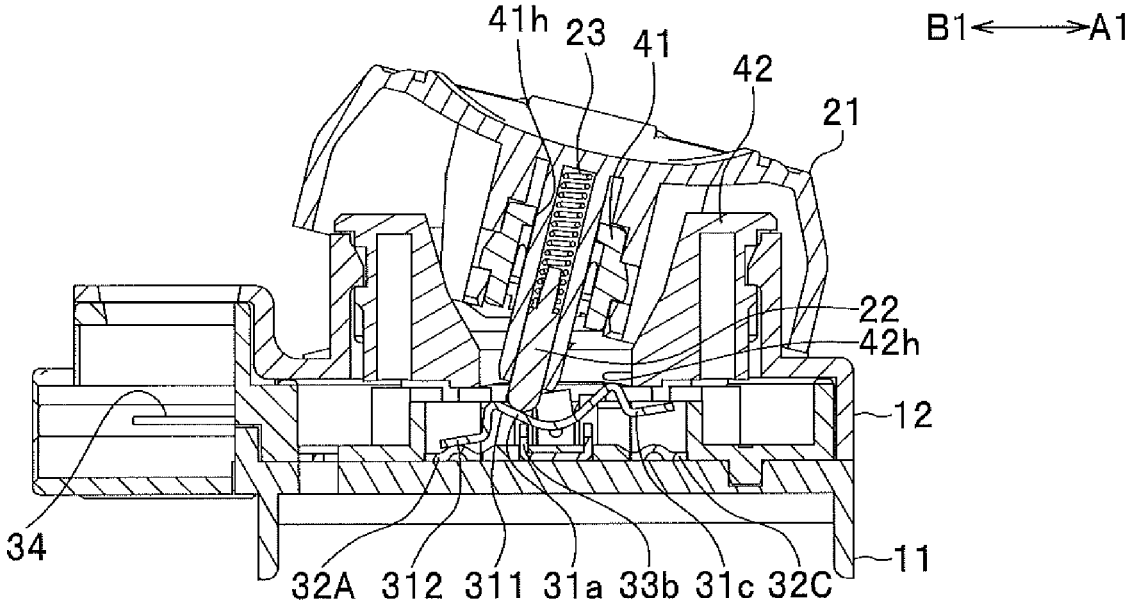
FIG. 8C is a cross-sectional view, taken along a line VIIIC-VIIIC, of the multifunction switch in FIG. 8A.

As shown in FIGS. 8A and 8B, the portion 21*a* of the control cap 21 is pressed downward to swing the control cap 21 toward the direction as indicated by A1. At this time, as shown in FIG. 8C, the control pin 22 is swung clockwise to make a tip of the control pin 22 slide from the lower end of the swinging portion 311 of the movable contact plate 31*a* toward the fulcrum plate 33*b*, causing the coil spring 23 to be pressed and compressed by the control pin 22. Once the control pin 22 further swings with the tip of the control pin 22 going over the fulcrum plate 33*b*, the control pin 22 is biased by the coil spring 23 to press the movable contact plate 31*a* downward. This causes the movable contact plate 31*a* to swing counterclockwise about the fulcrum plate 33*b* to make the contact portion 312 move downward and contact the fixed contact 32A. As a result, the contact circuit 30 is closed.

Figure 8D:
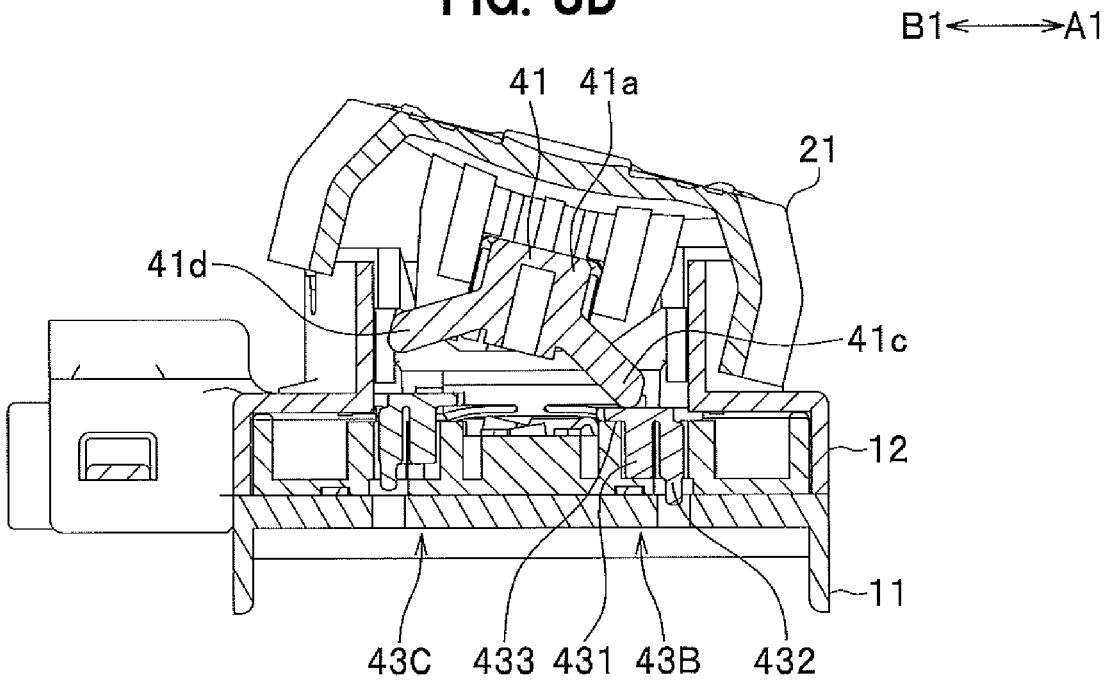
FIG. 8D is a cross-sectional view, taken along a line VIIID-VIIID, of the multifunction switch in FIG. 8A.

On another front, as shown in FIG. 8D, the control pin 22 is swung clockwise and comes in contact with the first movable element 41, to make the first movable element 41 swing clockwise. At this time, the leg portions 41*b* and 41*c* of the first movable element 41 arranged on the opposite side of the control pin 22 from the movable contact plate 31*a* are swung and moved downward to press the sliders 43A and 43B, respectively. The sliders 43A and 43B are moved downward. At this time, the control pin 22 is moved along the guide hole 42*h* of the second movable element 42, and therefore the second movable element 42 is not swung.

Figure 9A:
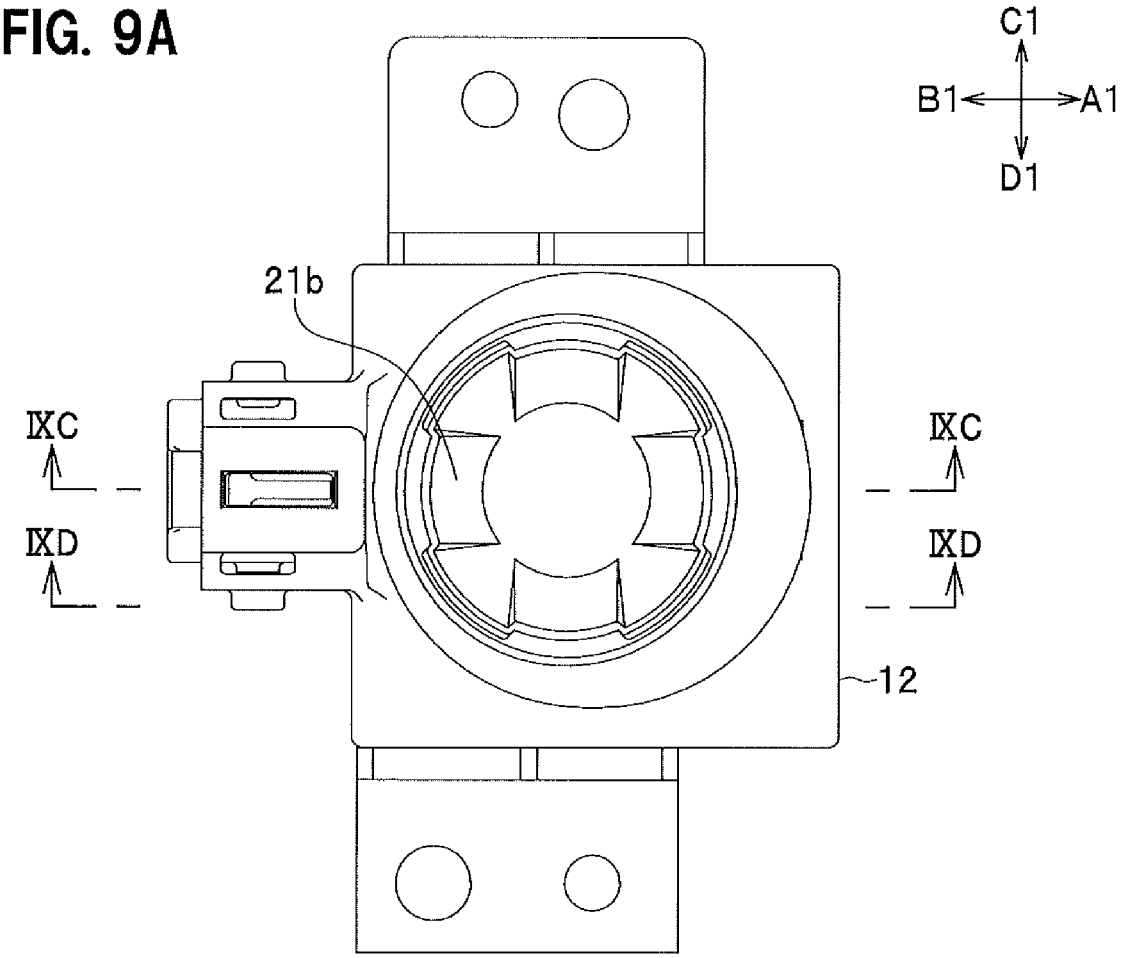
FIG. 9A is a plan view of the multifunction switch having the control cap swung toward a direction indicated by B1.
Figure 9B:
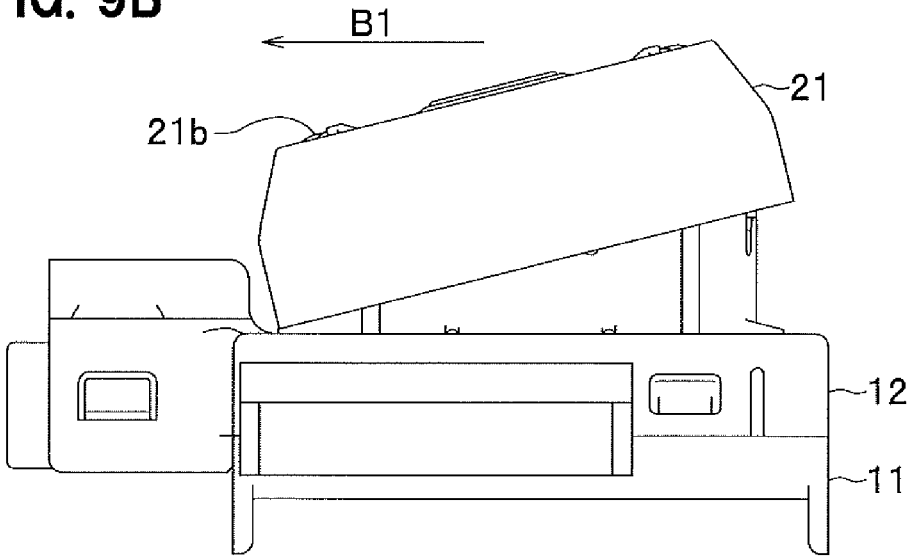
FIG. 9B is a side view of the multifunction switch in FIG. 9A.
Figure 9C:
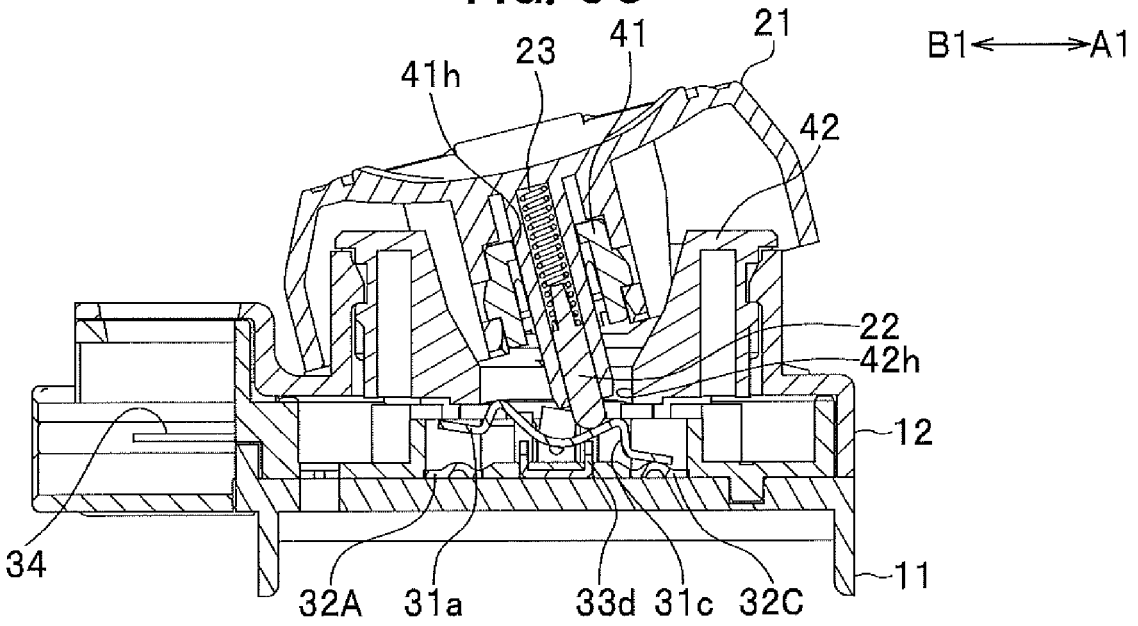
FIG. 9C is a cross-sectional view, taken along a line IXC-IXC, of the multifunction switch in FIG. 9A.

Next, as shown in FIGS. 9A and 9B, the portion 21*b* of the control cap 21 is pressed downward to swing the control cap 21 toward the direction as indicated by B1 opposite to A1. At this time, as shown in FIG. 9C, the control pin 22 is swung counterclockwise to make the tip of the control pin 22 slide on the movable contact plate 31*c* toward the fulcrum plate 33*d*. Once the tip of the control pin 22 goes over the fulcrum plate 33*d*, the control pin 22 is biased by the coil spring 23 to press the movable contact plate 31*c* downward. This causes the movable contact plate 31*c* to swing clockwise about the fulcrum plate 33*d* and contact the fixed contact 32C.

Figure 9D:
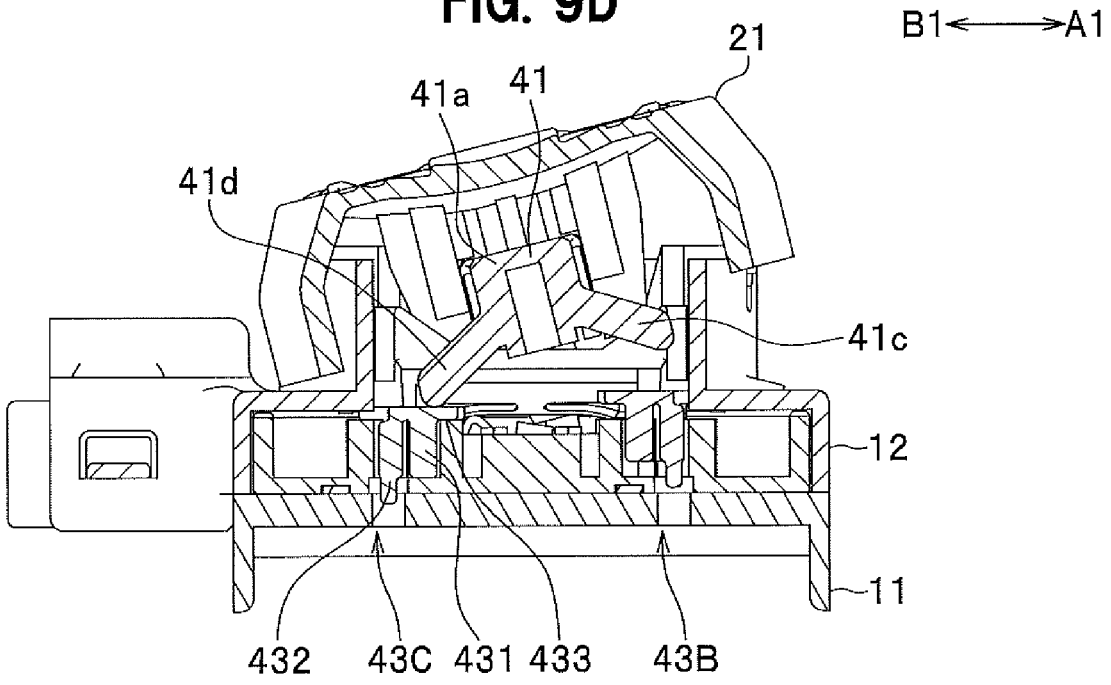
FIG. 9D is a cross-sectional view, taken along a line IXD-IXD, of the multifunction switch in FIG. 9A.

On another front, as shown in FIG. 9D, the control pin 22 is swung counterclockwise to make the first movable element 41 swing counterclockwise. At this time, the legs 41*d* and 41*e* of the first movable element 41 are moved downward to press the sliders 43C and 43D, respectively, and the sliders 43C and 43D are moved downward. At this time, the control pin 22 is moved along the guide hole 42*h* of the second movable element 42, and therefore the second movable element 42 is not swung.

Figure 10A:
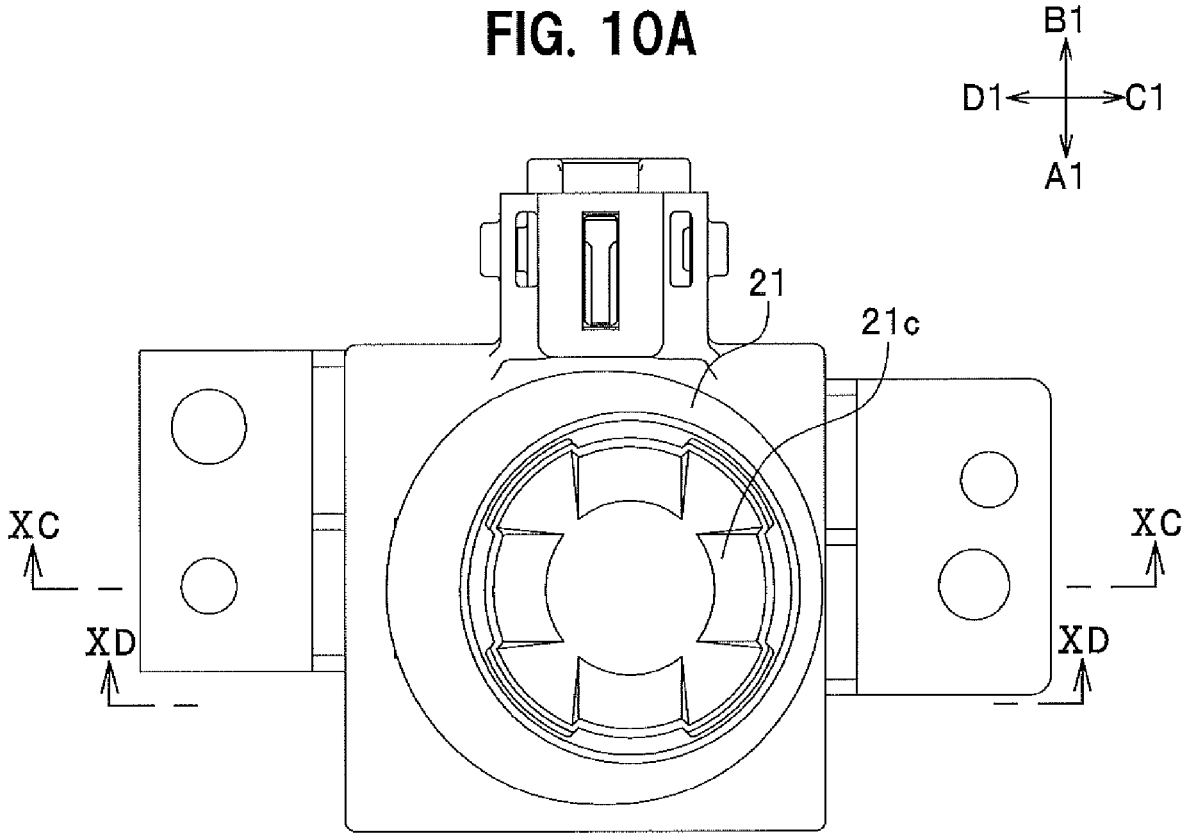
FIG. 10A is a plan view of the multifunction switch having the control cap swung toward a direction indicated by C1.
Figure 10B:
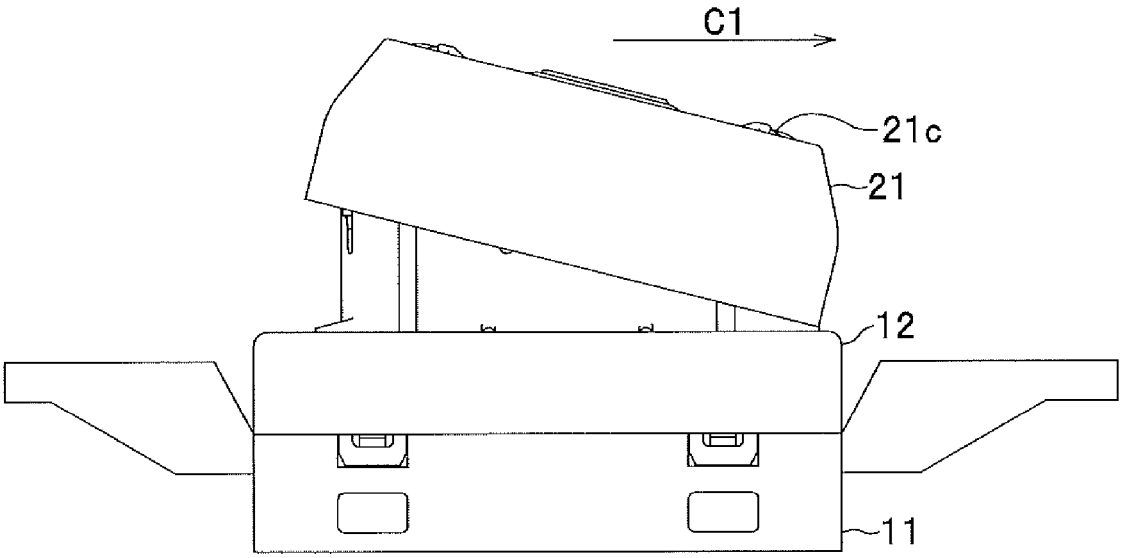
FIG. 10B is a side view of the multifunction switch in FIG. 10A.
Figure 10C:
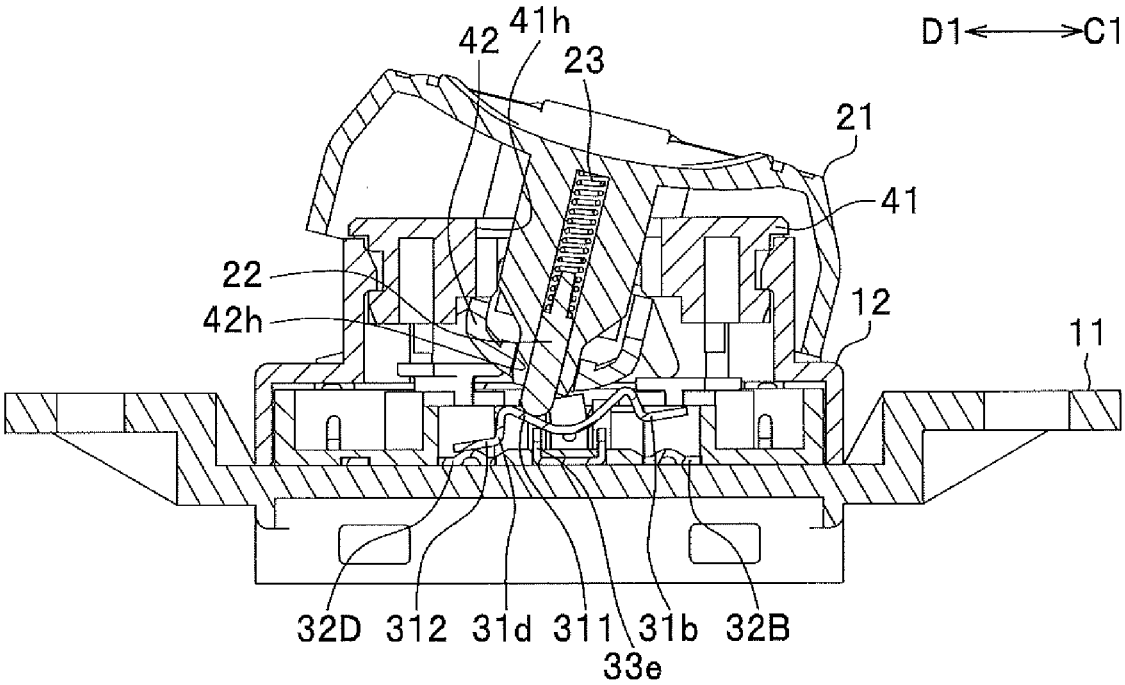
FIG. 10C is a cross-sectional view, taken along a line XC-XC, of the multifunction switch in FIG. 10A.

As shown in FIGS. 10A and 10B, the portion 21*c* of the control cap 21 is pressed downward to swing the control cap 21 toward the direction as indicated by C1 orthogonal to A1. At this time, as shown in FIG. 10C, the control pin 22 is swung clockwise to make the tip of the control pin 22 slide on the swinging portion 311 of the movable contact plate 31*d* toward the fulcrum plate 33*e*. Once the tip of the control pin 22 goes over the fulcrum plate 33*e*, the control pin 22 is biased by the coil spring 23 to press the movable contact plate 31*d* downward. This causes the movable contact plate 31*d* to swing counterclockwise about the fulcrum plate 33*e* to make the contact portion 312 of the movable contact plate 31*d* contact the fixed contact 32D.

Figure 10D:
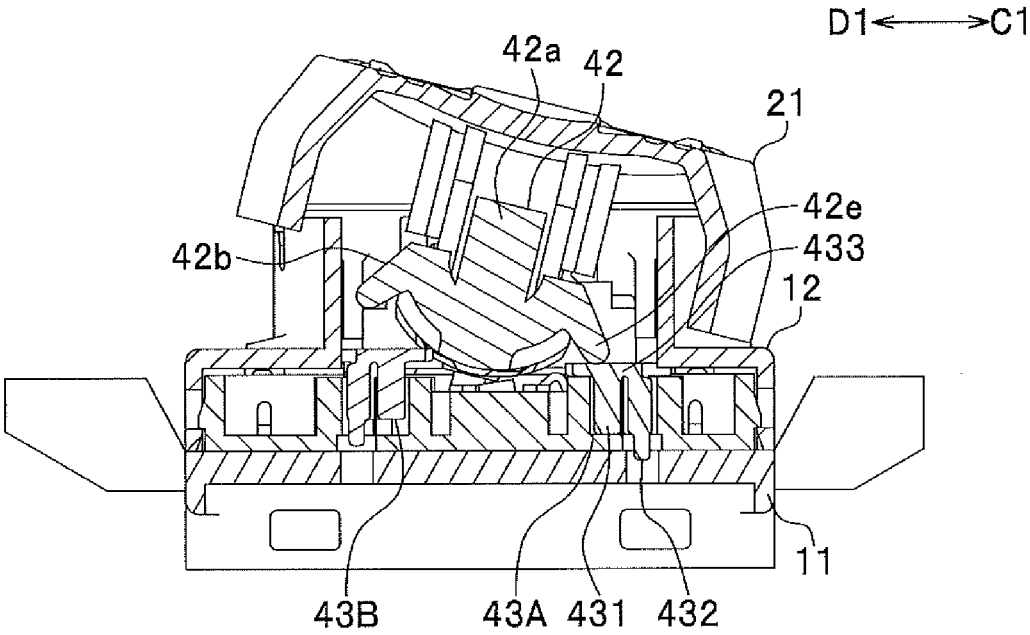
FIG. 10D is a cross-sectional view, taken along a line XD-XD, of the multifunction switch in FIG. 10A.

On another front, as shown in FIG. 10D, the control pin 22 comes in contact with the second movable element 42 to make the second movable element 42 swing clockwise. At this time, the leg portions 42*d* and 42*e* of the second movable element 42 are moved downward to press the sliders 43D and 43A, respectively, and the sliders 43D and 43A are moved downward. At this time, the control pin 22 is moved along the guide hole 41*h* of the first movable element 41, and therefore the first movable element 41 is not swung.

Figure 11A:
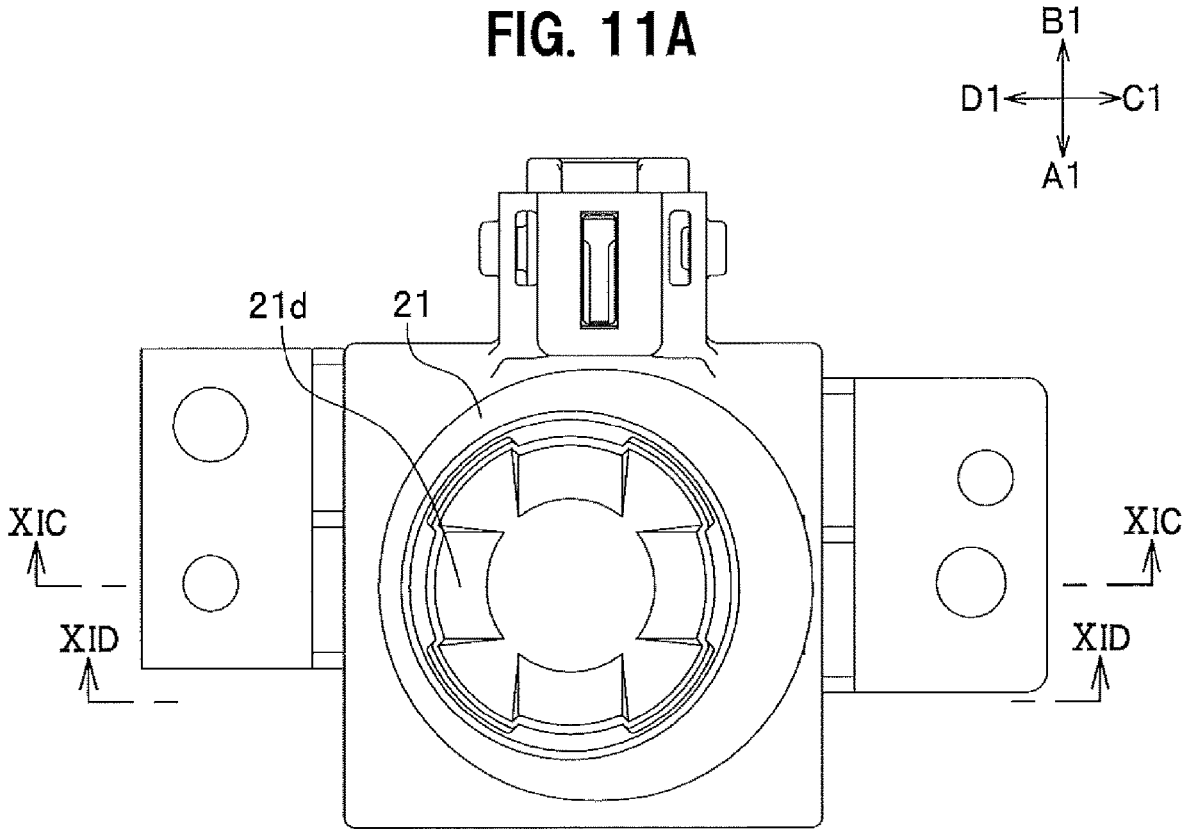
FIG. 11A is a plan view of the multifunction switch having the control cap swung toward a direction indicated by D1.
Figure 11B:
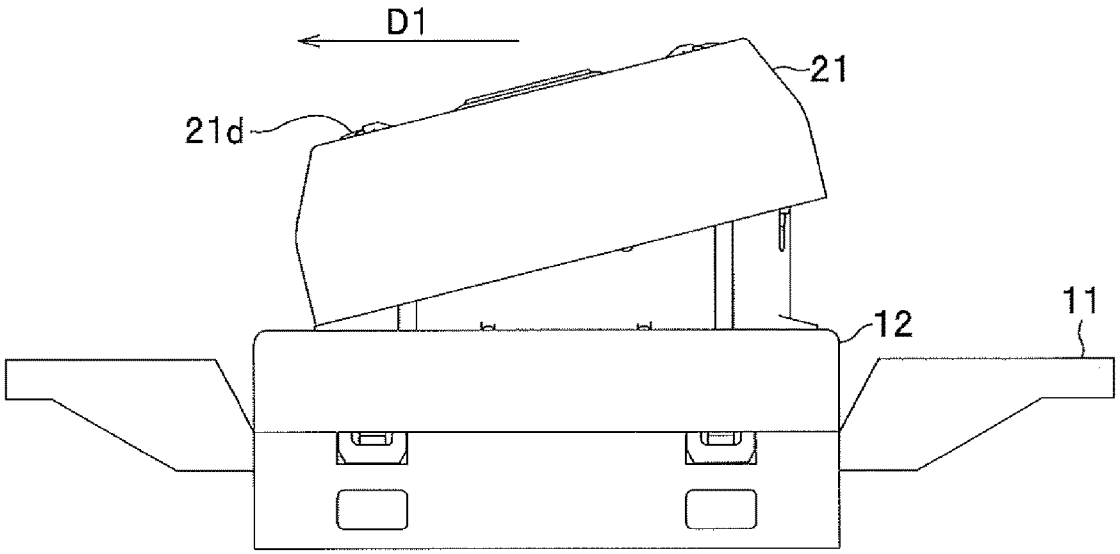
FIG. 11B is a side view of the multifunction switch in FIG. 11A.
Figure 11C:
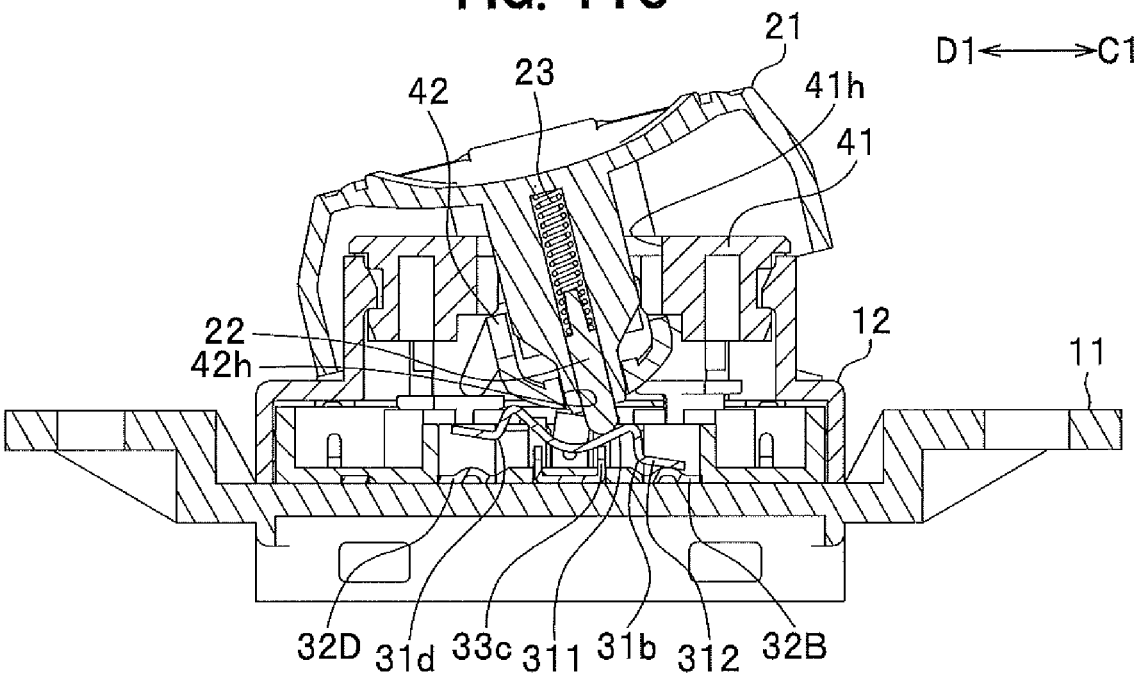
FIG. 11C is a cross-sectional view, taken along a line XIC-XIC, of the multifunction switch in FIG. 11A.

As shown in FIGS. 11A and 11B, the portion 21*d* of the control cap 21 is pressed downward to swing the control cap 21 toward the direction as indicated by D1 opposite to C1. At this time, as shown in FIG. 11C, the control pin 22 is swung counterclockwise to make the tip of the control pin 22 slide on the movable contact plate 31*b* toward the fulcrum plate 33*c*. Once the tip of the control pin 22 goes over the fulcrum plate 33*c*, the control pin 22 is biased by the coil spring 23 to press the movable contact plate 31*b* downward. This causes the movable contact plate 31*b* to swing clockwise about the fulcrum plate 33*c* to make the contact portion 312 of the movable contact plate 31*b* move downward and contact the fixed contact 32B.

Figure 11D:
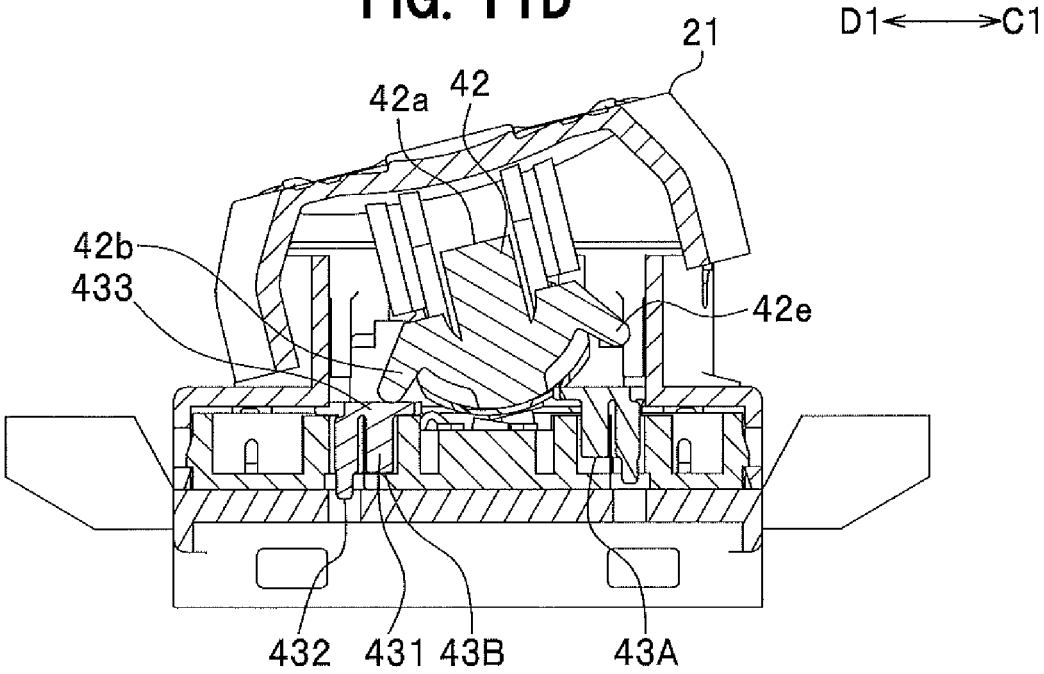
FIG. 11D is a cross-sectional view, taken along a line XID-XID, of the multifunction switch in FIG. 11A.

On another front, as shown in FIG. 11D, the control pin 22 is swung counterclockwise to make the second movable element 42 swing counterclockwise. At this time, the leg portions 42*b* and 42*c* of the second movable element 42 are moved downward to press the sliders 43B and 43C, respectively, and the sliders 43B and 43C are moved downward. At this time, the control pin 22 is moved along the guide hole 41*h* of the first movable element 41, and therefore the first movable element 41 is not swung.

The above embodiment allows for implementing switching for the contact switch composed of the movable contact 31 and the fixed contact 32, and switching for a mechanical element, such as switching operation modes of a mechanical mechanism, switching for a microswitch, switching for an additional contact switch, and switching for a valve, by operating the movable mechanism 40.

The movable contact plates 31*a* to 31*d* of the movable contact 31 are integrally formed, to allow for reducing the number of parts and facilitating an assembling work. For example, if a switch is designed to include an electrical switch and an electromagnetic valve, the number of parts increases and the part costs also increase. However, the present embodiment allows for increasing variations in switching operation with the reduced number of parts and an inexpensive configuration.

The leg portions 41*b* to 41*e* and 42*b* to 42*e* can expand a movable range without expanding the body portions 41*a* and 42*a*, to allow for reducing a device in weight and operating small mechanical elements.

The sliders 43A to 43D convert rotational movements of the first movable element 41 and the second movable element 42 into linear movements, to allow for linearly moving mechanical elements.

The guide hole 41*h* and the guide hole 42*h* guide the control pin 22 being moved, to allow one of the first movable element 41 and the second movable element to be swung by the control pin 22 without being restricted by the other of the first movable element 41 and the second movable element. This allows the first movable element 41 and the second movable element 42 to be moved independently from each other.

The body portion 41*a* of the first movable element 41 is disposed in the recess 42*k* of the second movable element 42 to allow an assembled structure of the first movable element 41 and the second movable element 42 to be reduced in size.

Note that the present embodiment can be modified to have the changed number of fixed contacts so as to be a 3-contact switch, a 2-contact switch, or a 1-contact switch, not just a 4-contact switch. The movable mechanism 40 is not limited to the first movable element 41 and the second movable element 42, and may have either one of these. In addition, any number of one to four may be selected as the number of the leg portions 41*b* to 41*e* of the first movable element 41 and as the number of the leg portions 42*b* to 42*e* of the second movable element 42.

Second Embodiment

Figure 12:
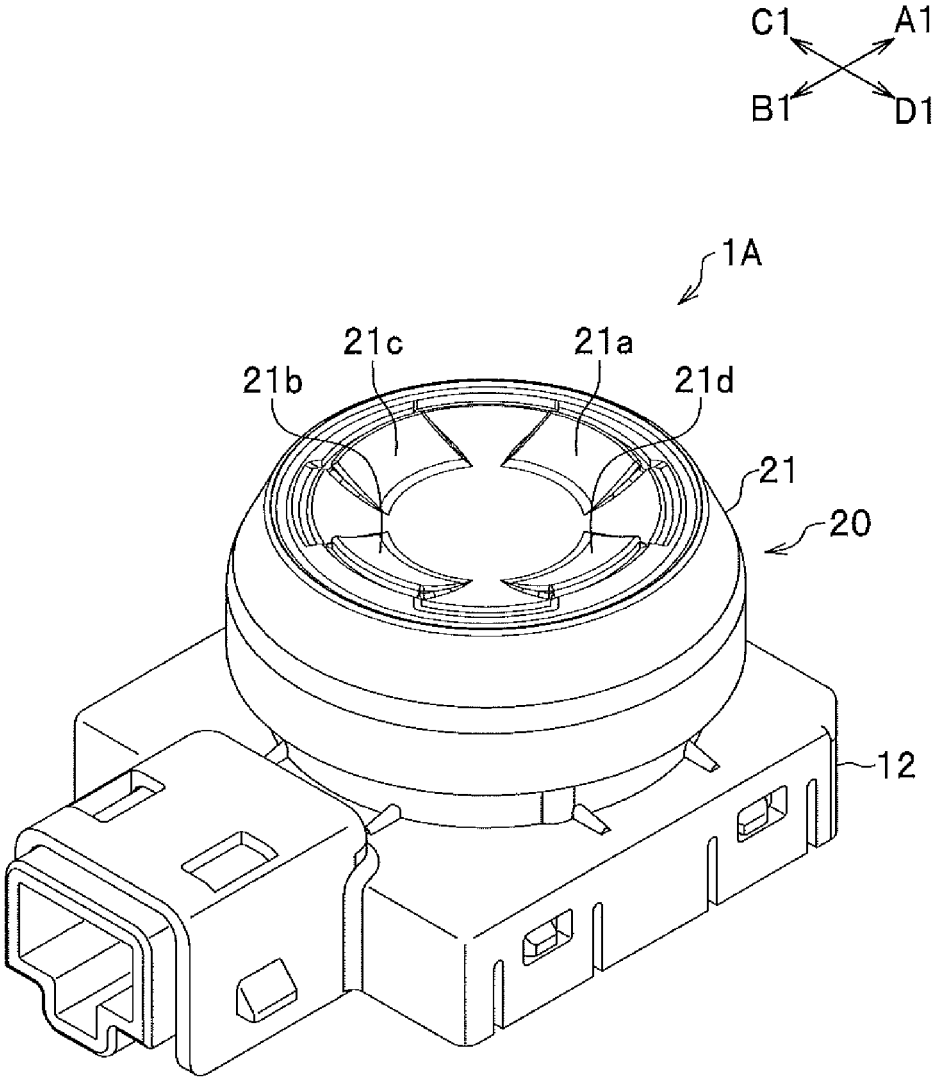
FIG. 12 is a perspective view of a multifunction switch of a second embodiment.
Figure 13A:
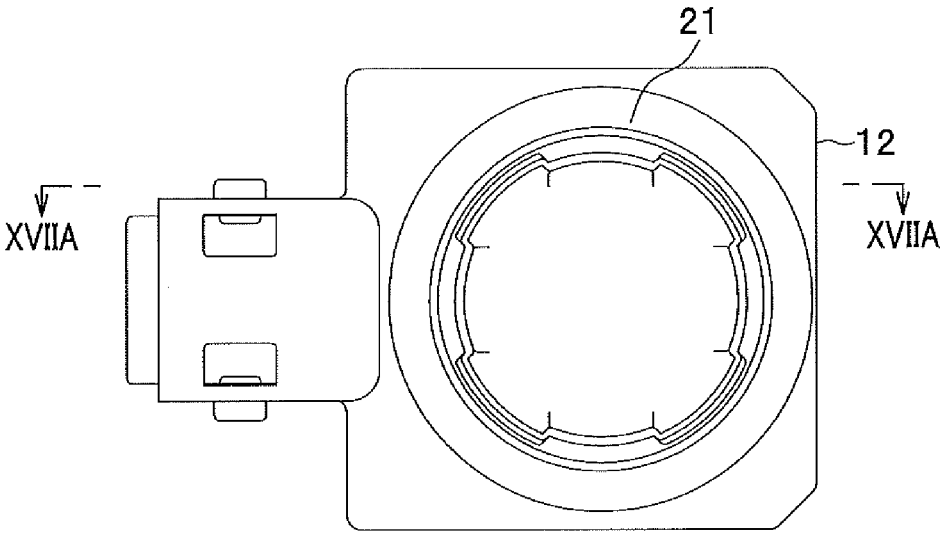
FIG. 13A is a plan view of the multifunction switch in FIG. 12.
Figure 13B:
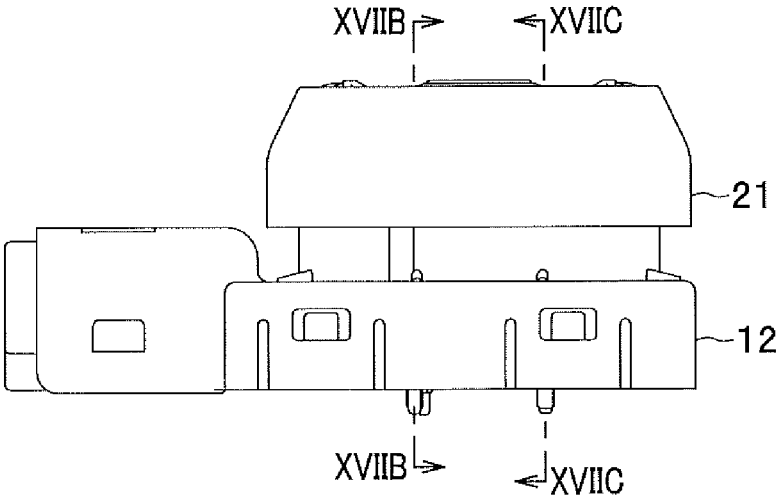
FIG. 13B is a side view of the multifunction switch in FIG. 12.
Figure 14A:
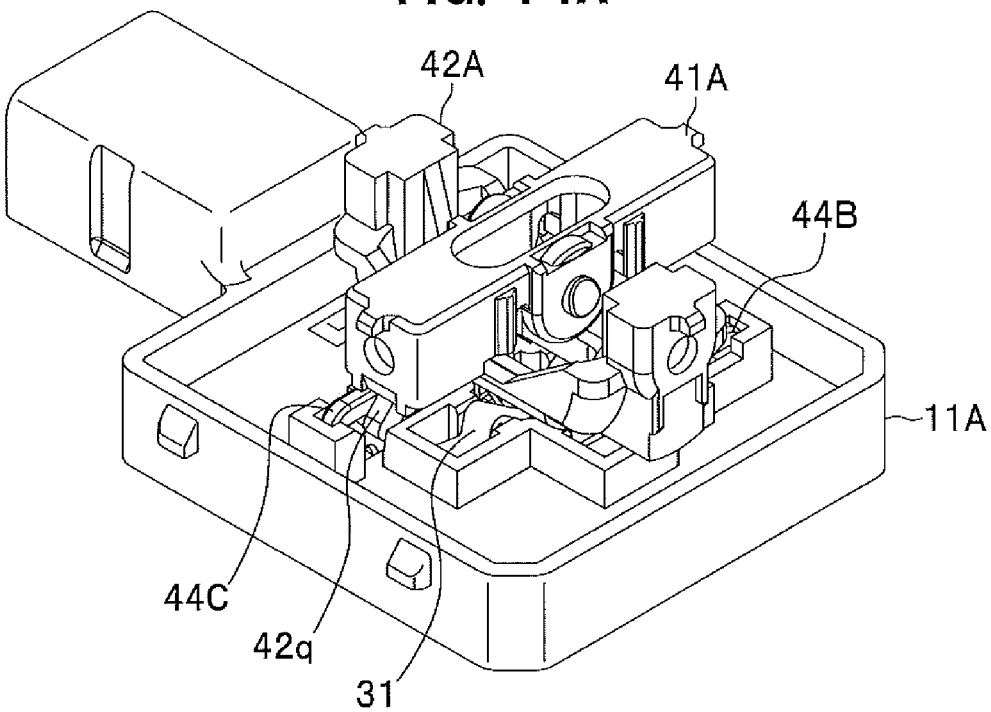
FIG. 14A is a partially-exploded perspective view of the multifunction switch in FIG. 12.
Figure 14B:
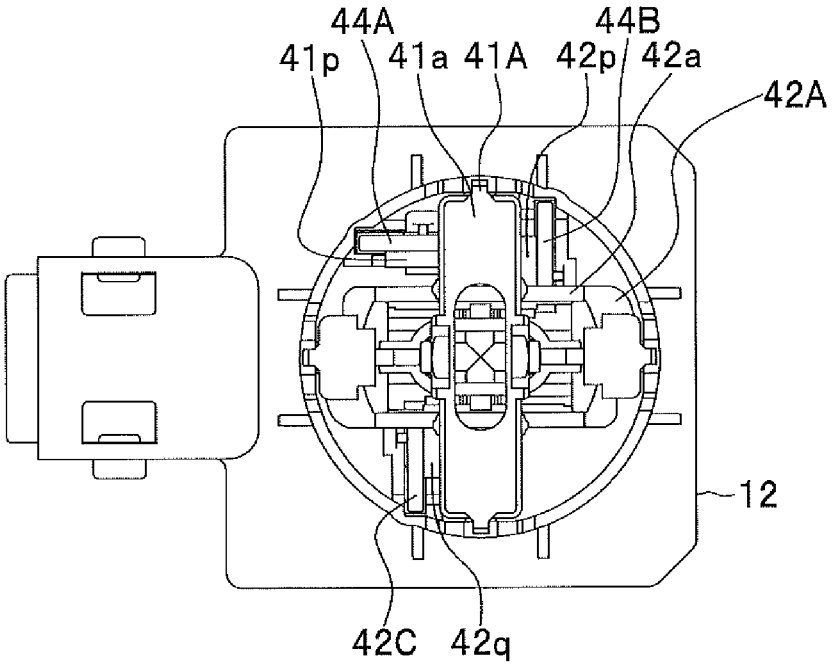
FIG. 14B is a partially-exploded plan view of the multi-function switch in FIG. 12.

A multifunction switch 1A shown in FIG. 12 is characterised in that a first movable element 41A is coupled with a driven slider 44A and a second movable element 42A is coupled with driven sliders 44B and 44C, as shown in FIG. 14B. Hereinafter, the same members as those in the first embodiment are denoted by the same reference numerals, and descriptions thereof are eliminated.

Figure 15:
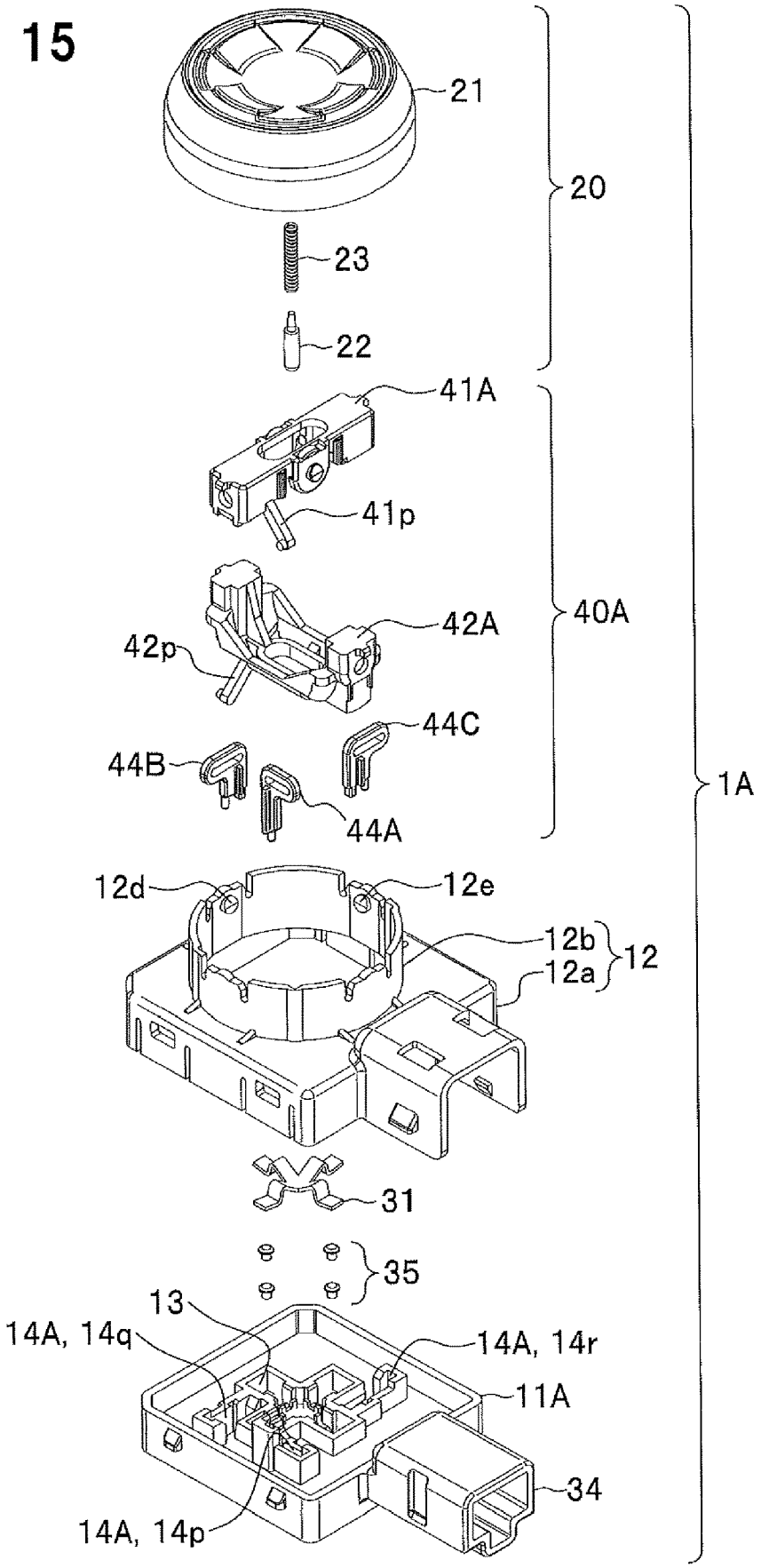
FIG. 15 is an exploded perspective view of the multi-function switch in FIG. 12.

A movable mechanism 40A includes a first movable element 41A, a second movable element 42A disposed to cross the first movable element 41A, the driven slider 44A associated with the first movable element 41A, and the driven sliders 44B and 44C associated with the second movable element 42A, as shown in FIG. 15. Note that a fixed contact 35 is in a cylindrical shape.

Figure 16A:
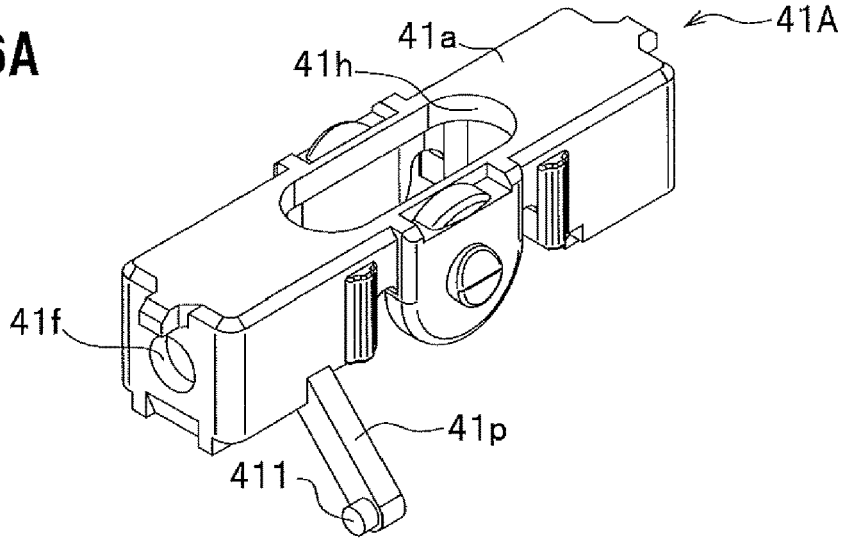
FIG. 16A is an enlarged perspective view of a first movable element in FIG. 15.
Figure 16B:
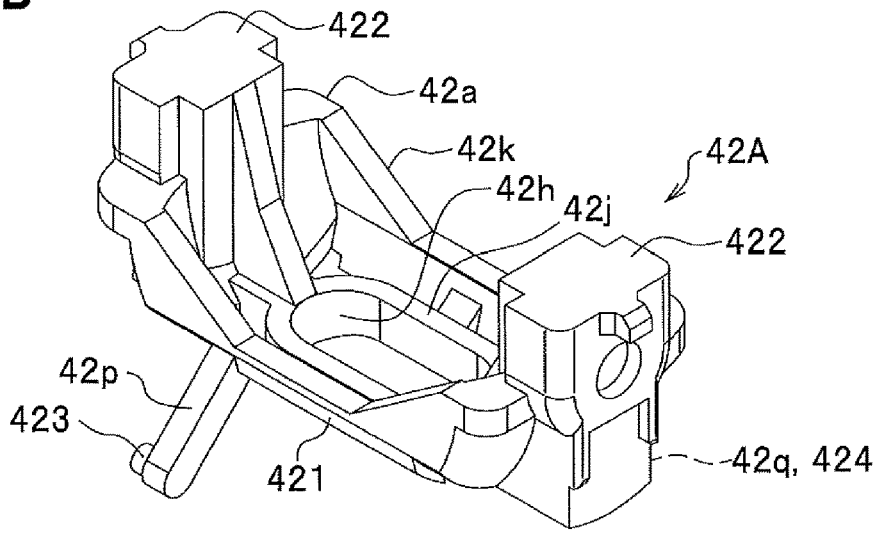
FIG. 16B is an enlarged perspective view of a second movable element in FIG. 15.

The first movable element 41A has a link leg portion 41*p* extending obliquely downward with respect to a side surface of a body portion 41*a* thereof from an edge between the side surface and a lower surface of the body portion 41*a*, as shown in FIG. 16A. The link leg portion 41*p* is set longer than the leg portions 41*b* to 41*e* of the first movable element 41 of the first embodiment. The link leg portion 41*p* has an engaging protrusion 411 protruding laterally from a tip thereof. The second movable element 42A has link leg portions 42*p* and 42*q* extending obliquely downward from a lower surface of a body portion 42*a* thereof, as shown in FIG. 16B. The link leg portion 41*p* has an engaging protrusion 423 protruding laterally from a tip thereof. The link leg portion 42*q* has an engaging protrusion 424 extending laterally from a tip thereof (see FIG. 17B). The link leg portions 42*p* and 42*q* are set longer than the leg portions 42*a* to 42*d* of the second movable element 42 of the first embodiment. As shown in FIG. 14B, the link leg portions 42*p* and 42*q* extend toward directions opposite to each other in a top view. In addition, the link leg portions 42*p* and 42*q* and the link leg portion 41*p* are arranged so as to form a right angle in a top view.

Figure 16C:
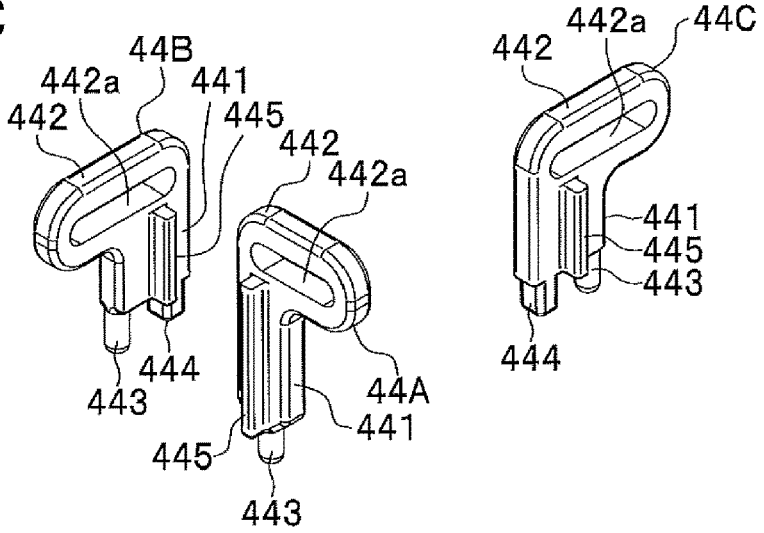
FIG. 16C is an enlarged perspective view of a driven slider in FIG. 15.

The driven slider 44A includes a slide portion 441, a coupling portion 442 integrated with the slide portion 441, a protrusion 443 extending from a lower end of the slide portion 441, and a positioning convex portion 445 protruding from a side surface of the slide portion 441, as shown in FIG. 16C. The coupling portion 442 has a guide hole 442*a* extending linearly in the lateral direction. Similarly, each driven slider 44B, 44C has a slide portion 441, a coupling portion 442, and a projection 443, and also has a projection 444 extending from the lower end of the slide portion 441.

Figure 17A:
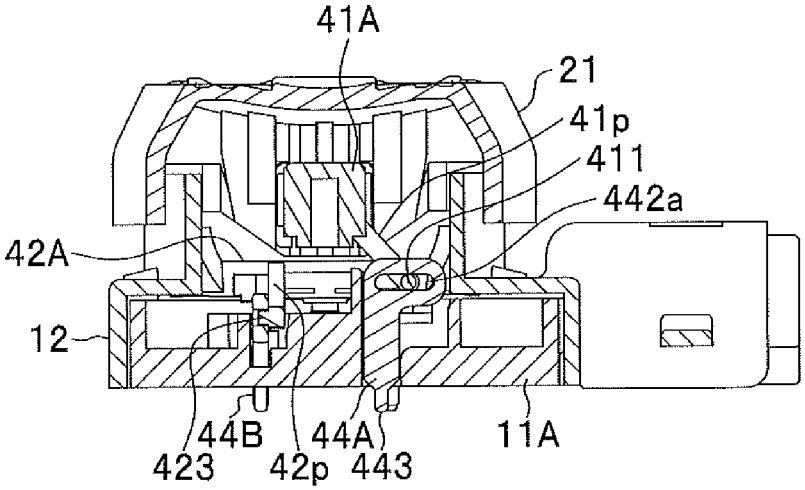
FIG. 17A is a cross-sectional view taken along a line XVIIA-XVIIA in FIG. 13A.
Figure 17B:
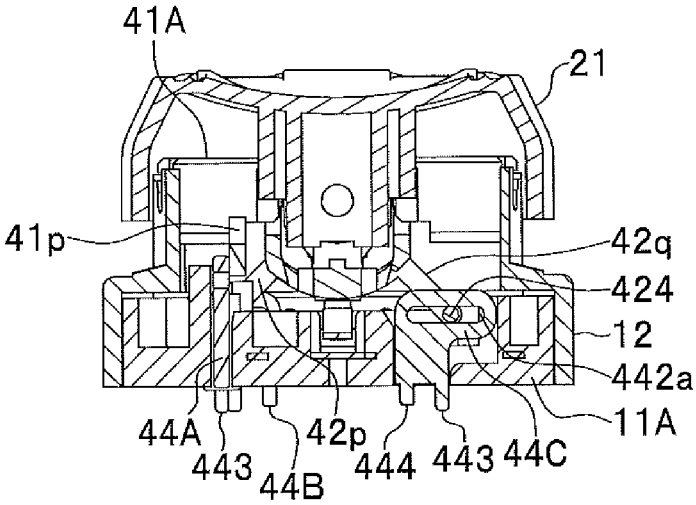
FIG. 17B is a cross-sectional view taken along a line XVIIB-XVIIB in FIG. 13B.
Figure 17C:
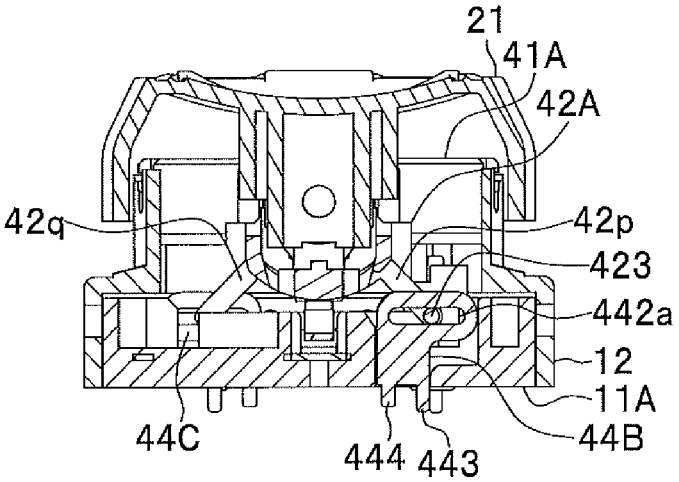
FIG. 17C is a cross-sectional view taken along a line XVIIC-XVIIC in FIG. 13B.

As shown in FIG. 17A, the engaging protrusion 411 of the link leg portion 41*p* of the first movable element 41A is inserted into a guide hole 442*a* of the driven slider 44A and is slidable within the guide hole 442*a*. As shown in FIG. 17B, the engaging protrusion 424 of the link leg portion 42*q* of the second movable element 42A is inserted into the guide hole 442*a* of the driven slider 44C and is slidable within the guide hole 442*a*. As shown in FIG. 17C, the engagement protrusion 423 of the link leg portion 42*p* of the second movable element 42A is inserted into the guide hole 442*a* of the driven slider 44B and is slidable within the guide hole 442*a*.

Figure 14C:
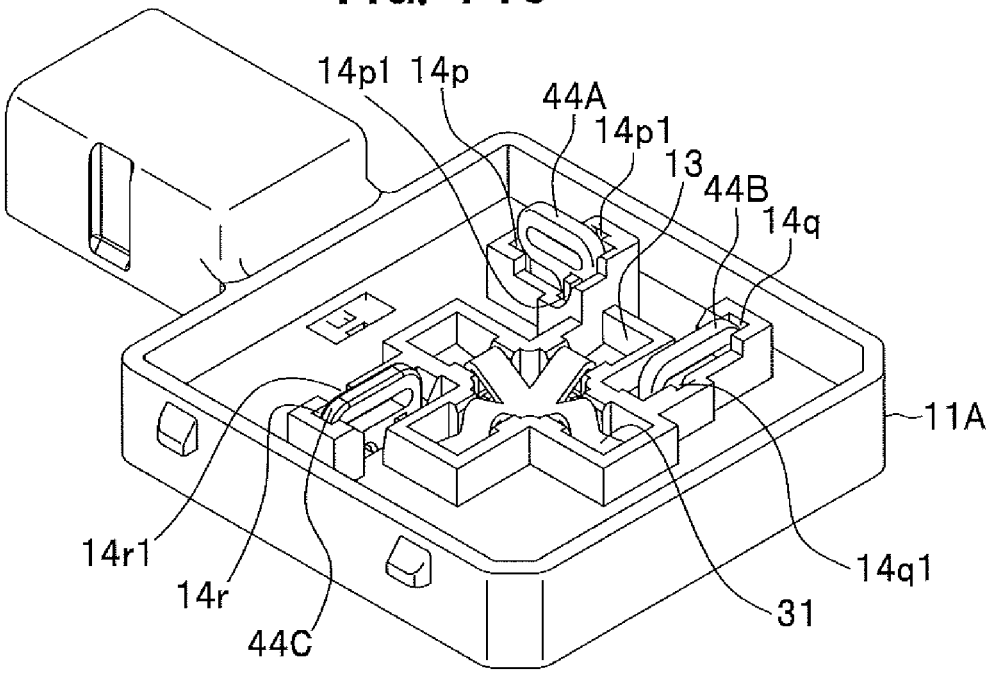
FIG. 14C is a partially-exploded perspective view of the multifunction switch in FIG. 12.
Figure 14D:
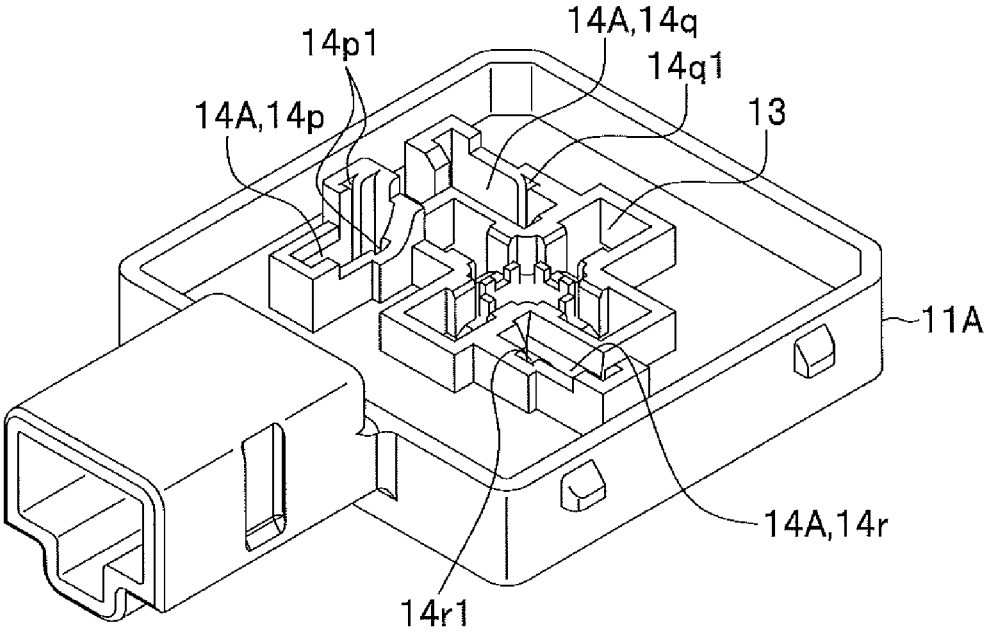
FIG. 14D is a perspective view of a basal plate of the multifunction switch in FIG. 12.

As shown in FIG. 14D, a basal plate 11A has three slider guide portions 14A adjacent to the contact receiver 13. The slider guide portions 14A have guide holes 14*p*, 14*q*, and 14*r*, respectively. A side wall defining the guide hole 14*p* has a positioning recess 14*p*1. A side wall defining the guide hole 14*q* has a positioning recess 14*q*1. A side wall defining the guide hole 14*r* has a positioning recess 14*r*1. As shown in FIG. 14C, the driven slider 44A is received in the guide hole 14*p*, and the positioning convex portion 445 is disposed in the positioning concave portion 14*p*1. A driven slider 44B is received in the guide hole 14*q*, and the positioning convex portion 445 is disposed in the positioning concave portion 14*q*1. The driven slider 44C is received in the guide hole 14*r*, and the positioning convex portion 445 is disposed in the positioning concave portion 14*r*1.

Figure 18A:
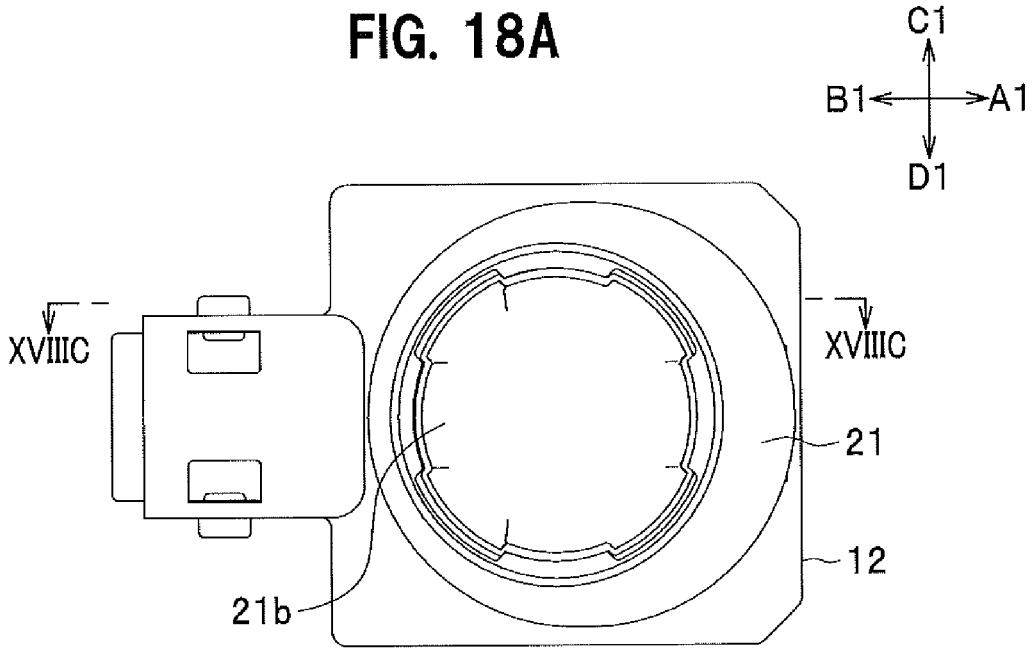
FIG. 18A is a plan view of the multi-function switch having the control cap swung toward the direction indicated by B1.
Figure 18B:
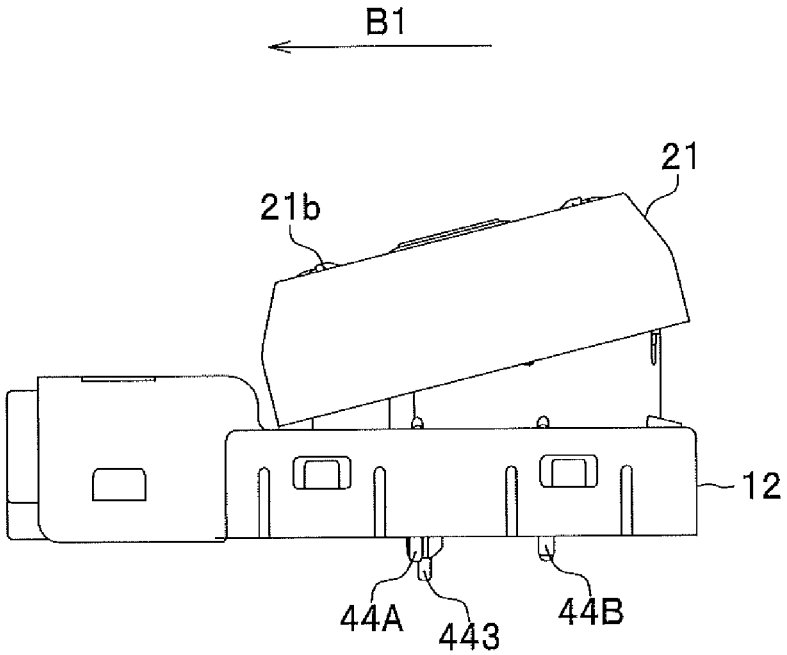
FIG. 18B is a side view of the multifunction switch having the control cap swung toward the direction indicated by B1.
Figure 18C:
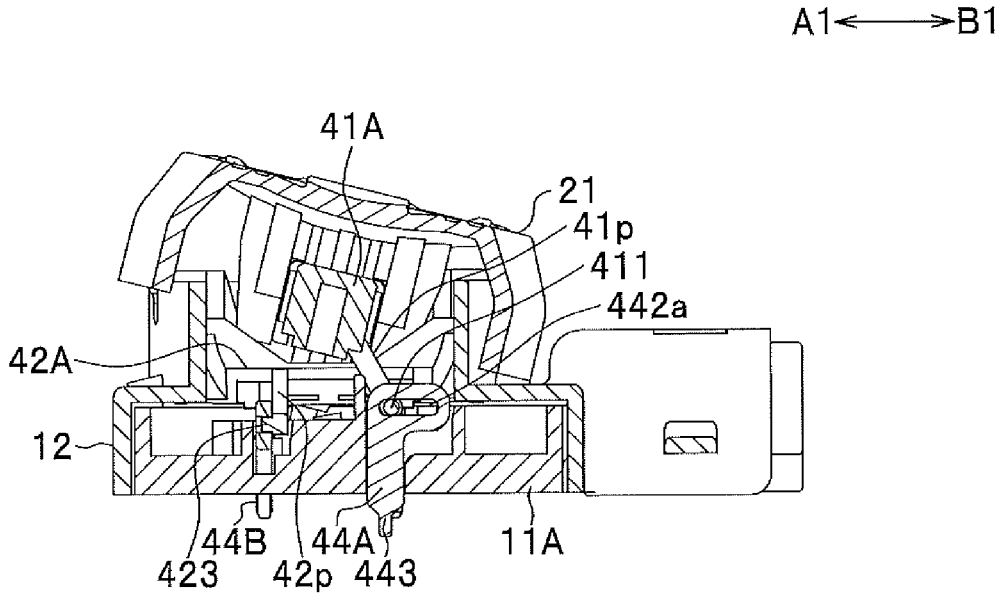
FIG. 18C is a cross-sectional view taken along a line XVIIIC-XVIIIC in FIG. 18A.

Next, operation of the multifunction switch 1A is described. Note that the operation of the contact circuit 30 is the same as that of the first embodiment, and therefore the description thereof is eliminated. As shown in FIGS. 18A and 18B, the portion 21*b* of the control cap 21 is pressed downward to swing the control cap 21 toward the direction as indicated by B1. At this time, the first movable element 41A is swung clockwise, as shown in FIG. 18C. The engagement protrusion 411 of the link leg portion 41*p* slides within the guide hole 442*a* toward the direction as indicated by A1 and moves the driven slider 44A downward. The protrusion 443 of the driven slider 44A presses a target element (not shown) for switching. Here, the driven slider 44A moves through a longer distance than the slider of the first embodiment, to allow the target element to have a wider movable range. In contrast, when the control cap 21 is swung toward the direction as indicated by A1 and returns to the neutral position, the first movable element 41A follows the movement of the control cap 21 and returns to the original posture, and the driven slider 44A also returns to the original position.

Figure 19A:
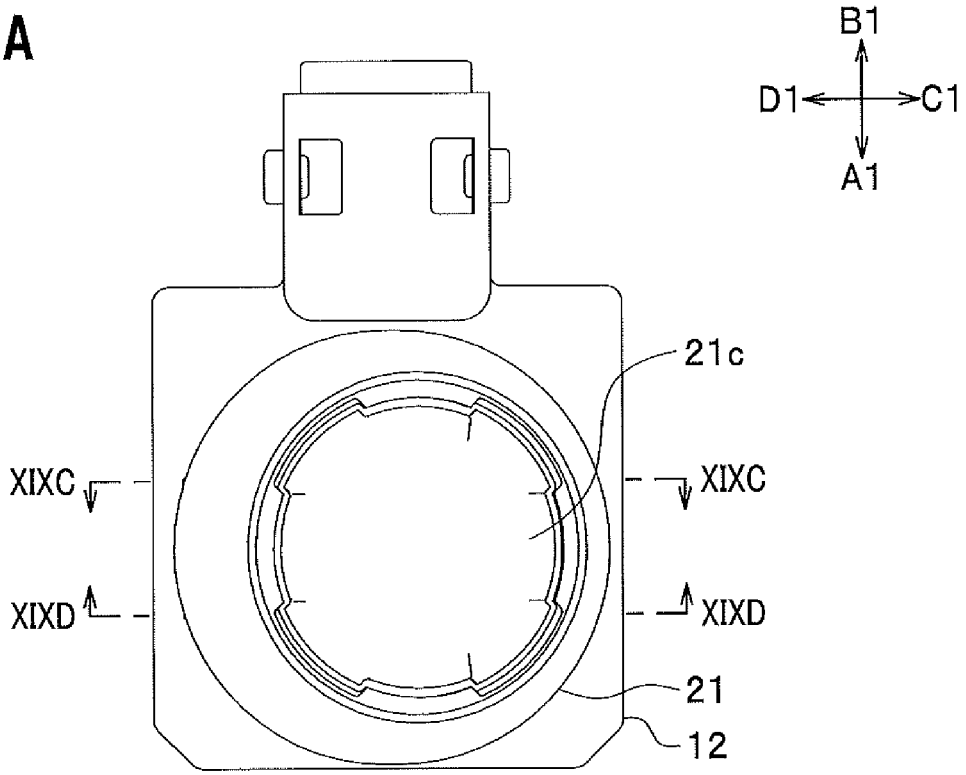
FIG. 19A is a plan view of the multifunction switch having the control cap swung toward the direction indicated by C1.
Figure 19B:
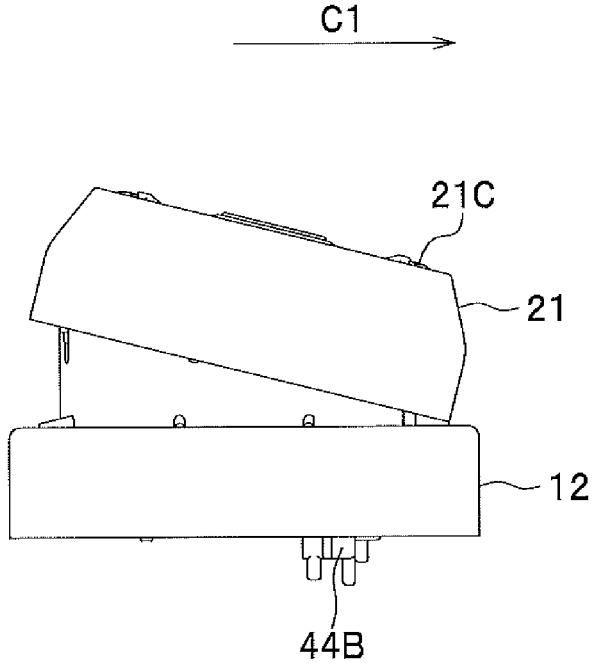
FIG. 19B is a side view of the multifunction switch having the control cap swung toward the direction indicated by C1.
Figure 19C:
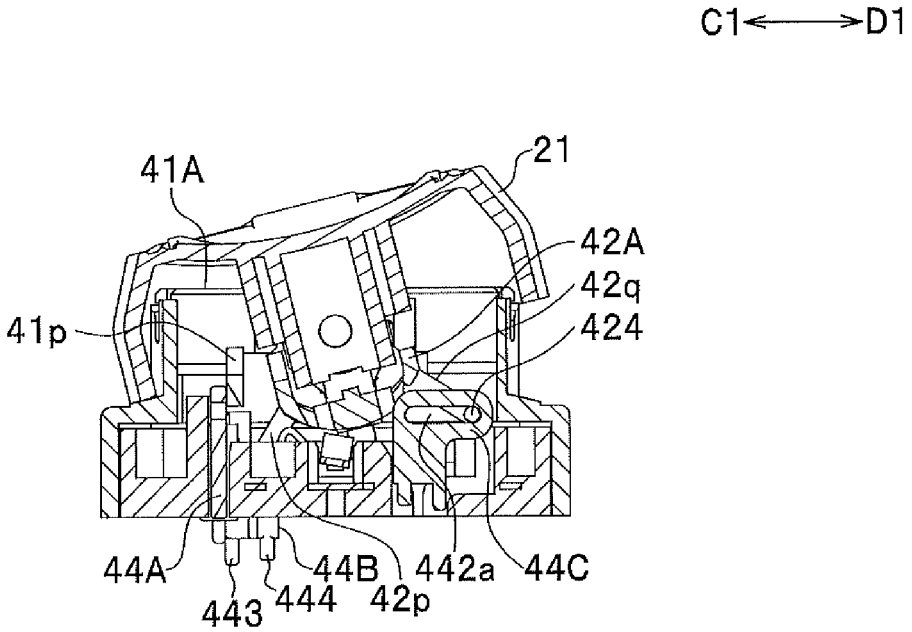
FIG. 19C is a cross-sectional view taken along a line XIXC-XIXC in FIG. 19A.
Figure 19D:
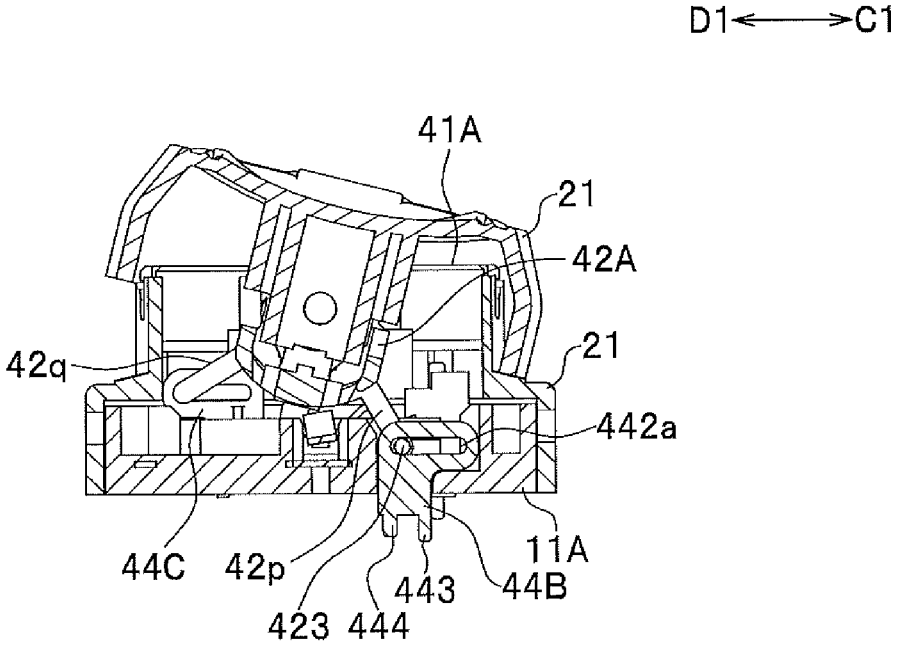
FIG. 19D is a cross-sectional view taken along a line XIXD-XIXD in FIG. 19A.

Next, as shown in FIGS. 19A and 19B, the portion 21*c* of the control cap 21 is pressed downward to swing the control cap 21 toward the direction as indicated by C1. At this time, the second movable element 42A is swung counterclockwise, as shown in FIG. 19C. The link leg portion 42*q* slides in the guide hole 442*a* of the driven slider 44C toward the direction as indicated by D1 and moves the driven slider 44C upward. On another front, as shown in FIG. 19D, the engaging protrusion 423 of the link leg portion 42*p* slides within the guide hole 442*a* of the driven slider 44B toward the direction as indicated by D1 and moves the driven slider 44B downward. The protrusions 443 and 444 of the driven slider 44B press a target element (not shown) for switching.

In the above multifunction switch 1A, the link leg portions 41*p*, 42*p*, and 42*q* are slidably coupled with the driven sliders 44A, 44B, and 44C, so that the driven sliders 44A, 44B, and 44C are allowed to have longer moving distances in accordance with the lengths of the link leg portions 41*p*, 42*p*, and 42*q*. This allows the target element to have a wider movable range, as compared with the first Embodiment. In addition, the link leg portions 41*p*, 42*p*, and 42*q* are coupled with the driven sliders 44A, 44B, and 44C, to allow the link leg portions 41 p, 42*p*, and 42*q* to surely move the driven sliders 44A, 44B, and 44C.

Third Embodiment

Figure 20A:
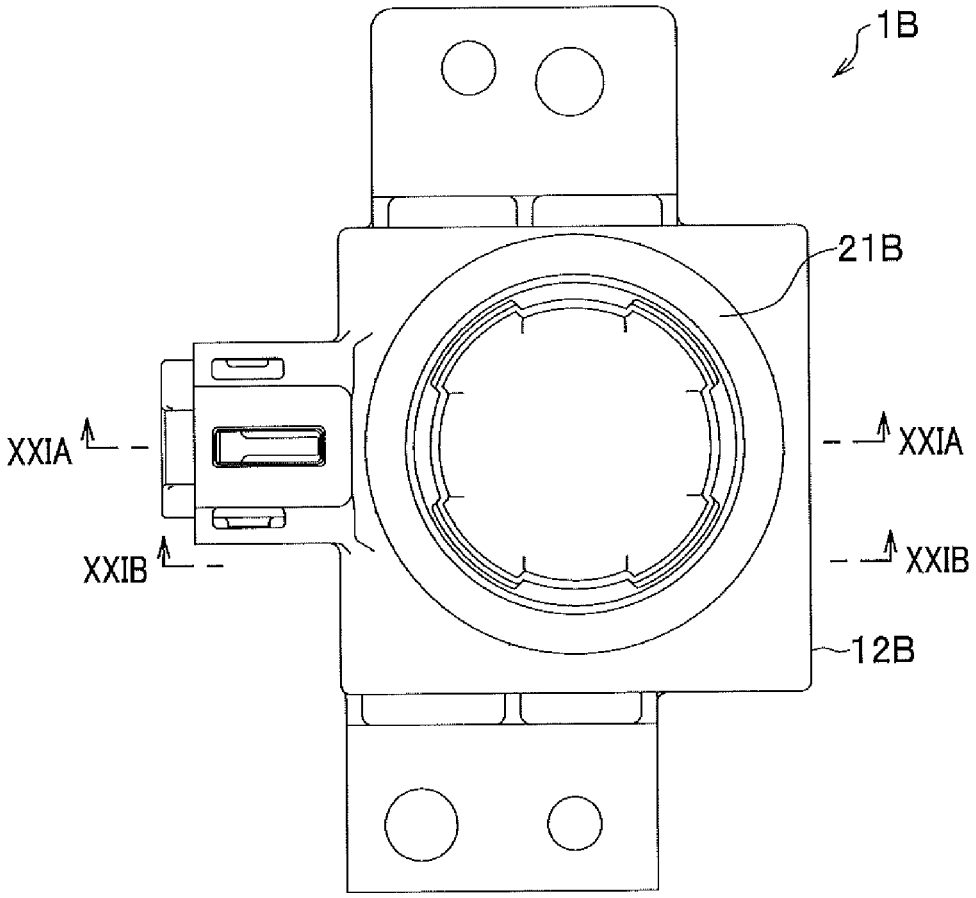
FIG. 20A is a plan view of a multifunction switch of a third embodiment.
Figure 20B:
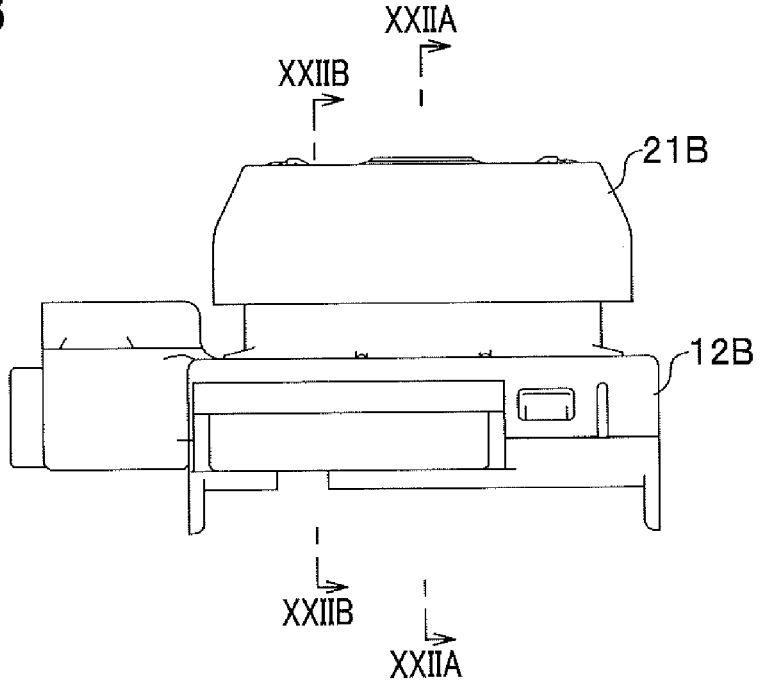
FIG. 20B is a side view of the multifunction switch in FIG. 20A.
Figure 20C:
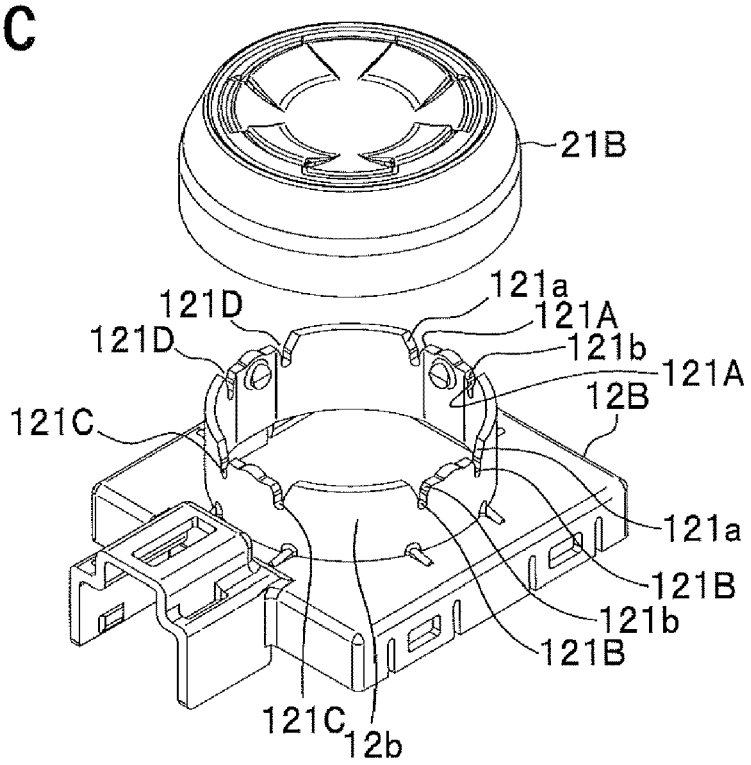
FIG. 20C is an exploded perspective view of the multi-function switch in FIG. 20A.
Figure 20D:
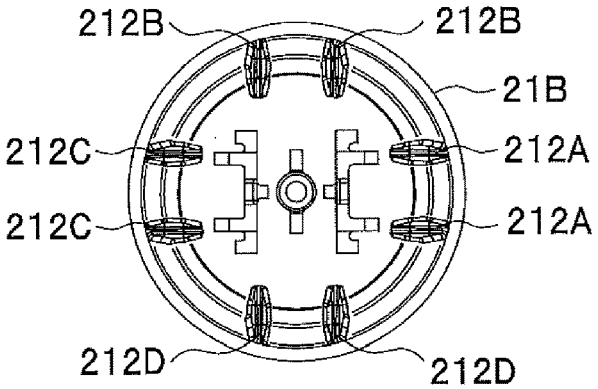
FIG. 20D is a bottom view of the control cap in FIG. 20C.
Figure 20E:
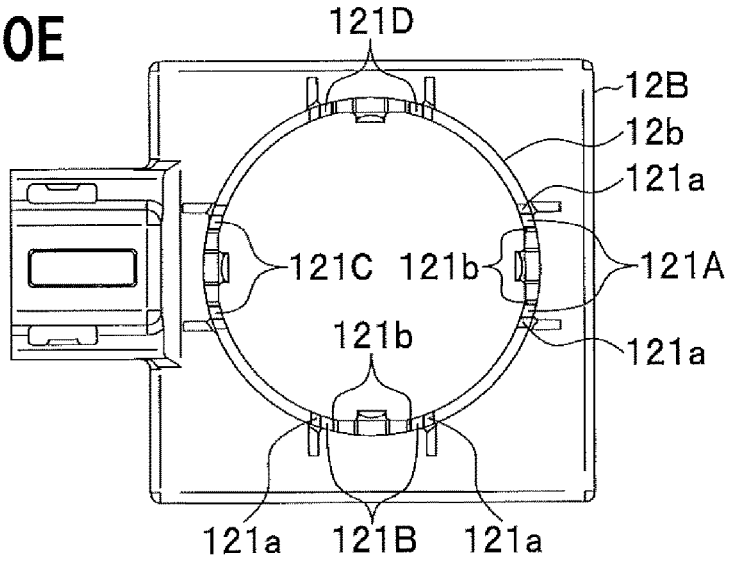
FIG. 20E is a top view of a case in FIG. 20C.

A multifunction switch 1B shown in FIGS. 20A and 20B is characterised in that a control cap 21B thereof is fixed in posture to prevent from being wrongly operated. As shown in FIG. 20D, the control cap 21B has positioning plate portions 212A, 212B, 212C, and 212D disposed, each in two locations, on the peripheral edge on the back side and formed in the circumferential direction at intervals of an angle of 90 degrees about the center thereof. As shown in FIG. 20E, a cylindrical case 12*b* of a case 12B of the multifunction switch 1B has slit portions 121A, 121B, 121C, and 121D formed, each in two locations, in the circumferential direction at intervals of an angle of 90 degrees about the center thereof. The slit portions 121A to 121D each extend downward from the upper end of the cylindrical case 12*b*. Both side walls of the respective slit portions 121A to 121D have, at upper portions thereof, guide walls 121*a* and 121*b* extending obliquely downward from the upper end of the cylindrical case 12*b*.

Figure 21A:
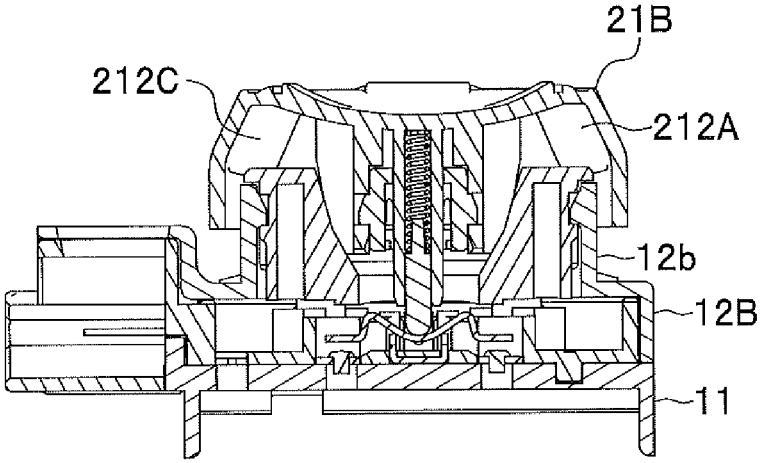
FIG. 21A is a cross-sectional view taken along a line XXIA-XXIA in FIG. 20A.
Figure 21B:
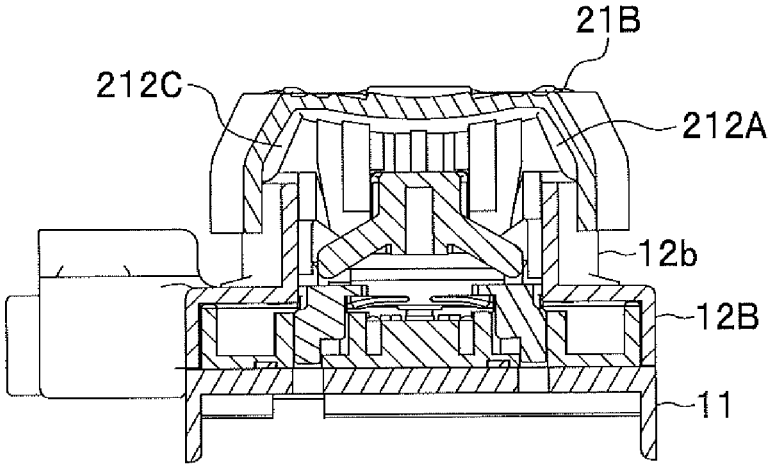
FIG. 21B is a cross-sectional view taken along a line XXIB-XXIB in FIG. 20A.
Figure 22A:
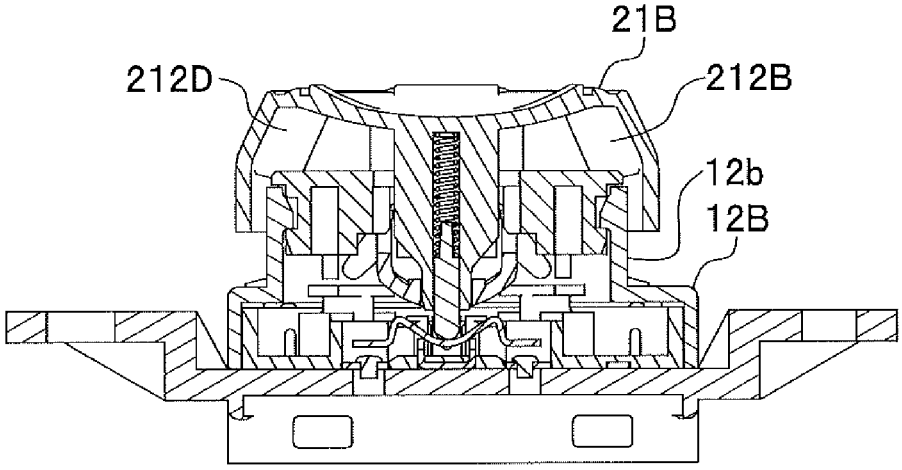
FIG. 22A is a cross-sectional view taken along a line XXIIA-XXIIA in FIG. 20B.
Figure 22B:
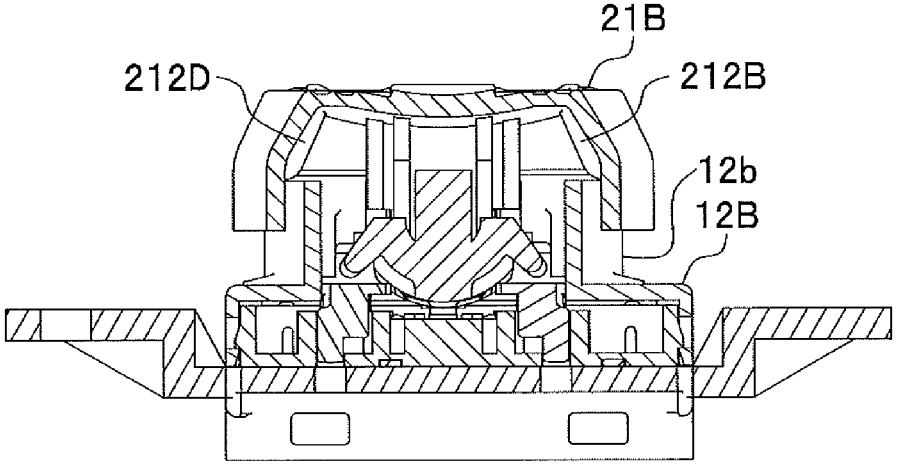
FIG. 22B is a cross-sectional view taken along a line XXIIB-XXIIB in FIG. 20B.

With reference to FIGS. 20D and 20E, the positioning plate portion 212A is associated with the slit portion 121A, the positioning plate portion 212B is associated with the slit portion 121B, the positioning plate portion 212C is associated with the slit portion 121C, and the positioning plate portion 212D is associated with the slit portion 121D. As shown in FIGS. 21A and 21B, the lower ends of the positioning plate portions 212A and 212B are positioned above the upper end of the cylindrical case 12*b*, that is, above the slit portions 121A and 121B. Similarly, as shown in FIGS. 22A and 22B, the lower ends of the positioning plate portions 212B and 212D are disposed above the upper end of the cylindrical case 12*b*, that is, above the slit portions 121B and 121D.

Figure 23A:
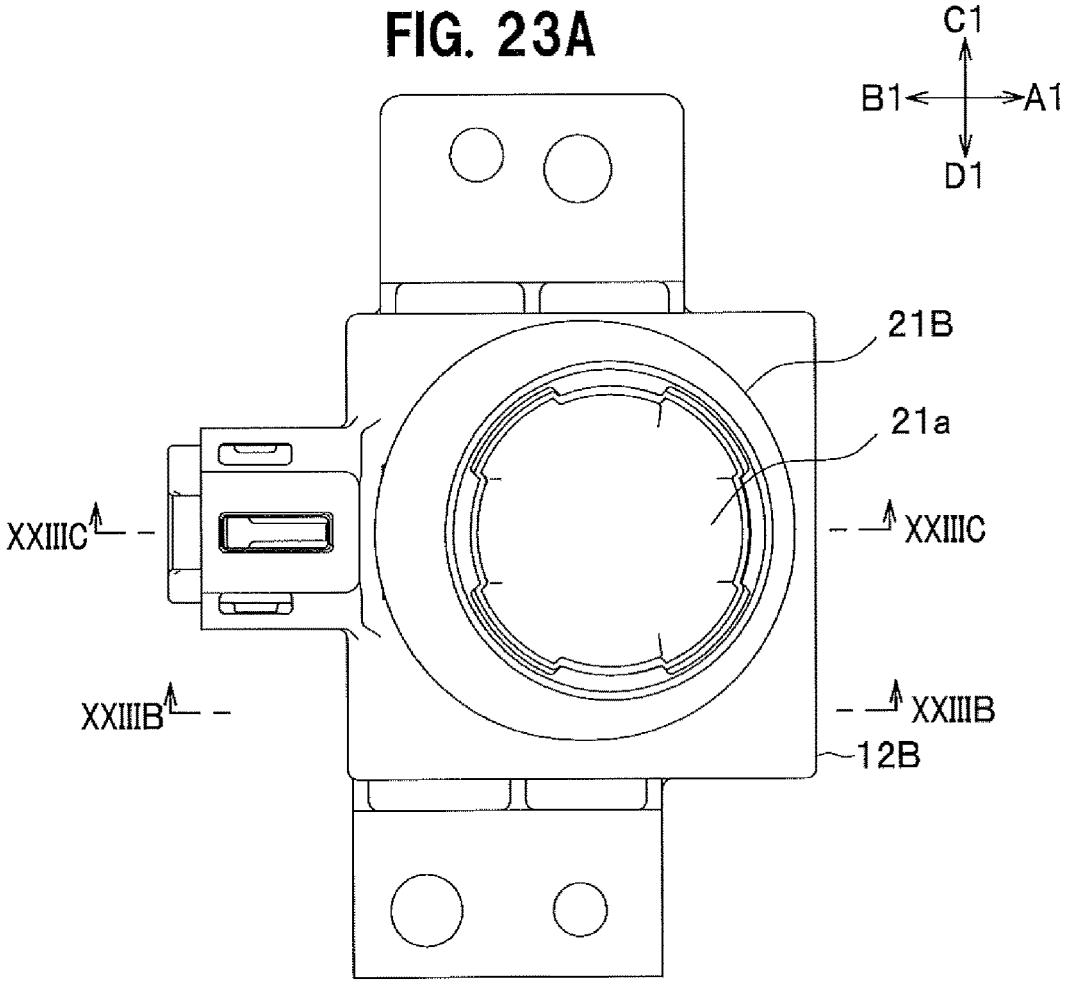
FIG. 23A is a plan view of the multi-function switch having the control cap swung toward the direction indicated by A1.
Figure 23B:
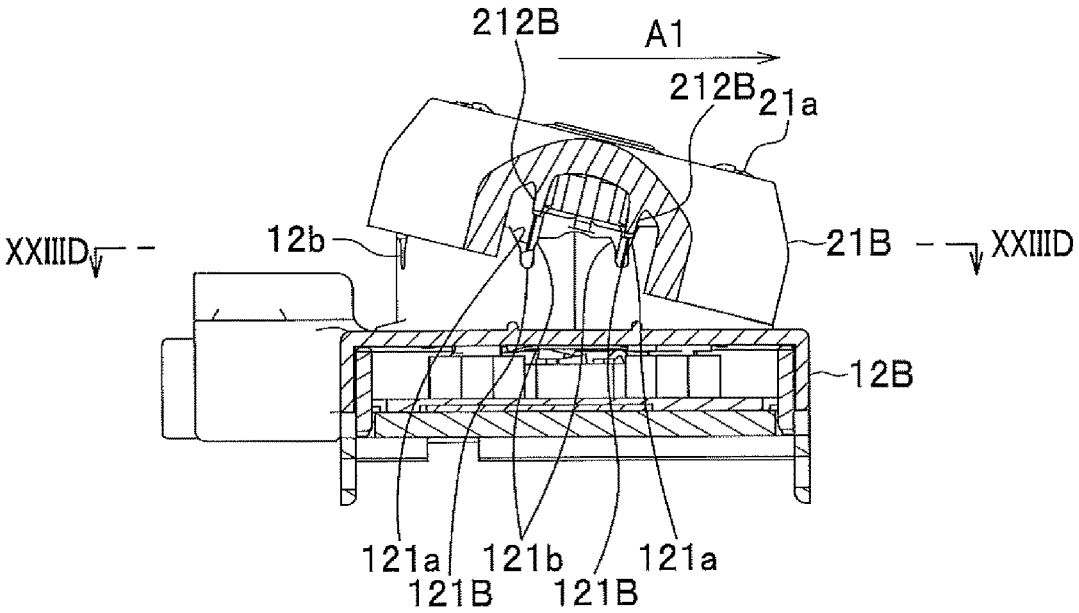
FIG. 23B is a cross-sectional view, taken along a line XXIIIB-XXIIIB in FIG. 23A, of the multifunction switch having the control cap swung toward the direction indicated by A1.
Figure 23C:
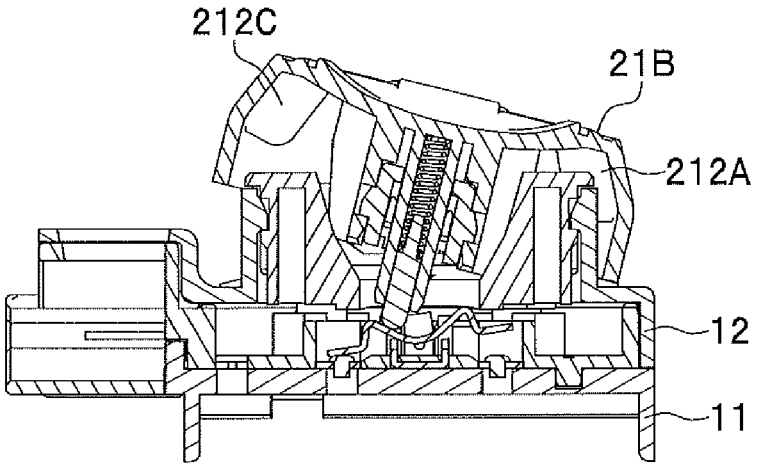
FIG. 23C is a cross-sectional view taken along a line XXIIIC-XXIIIC in FIG. 23A.
Figure 23D:
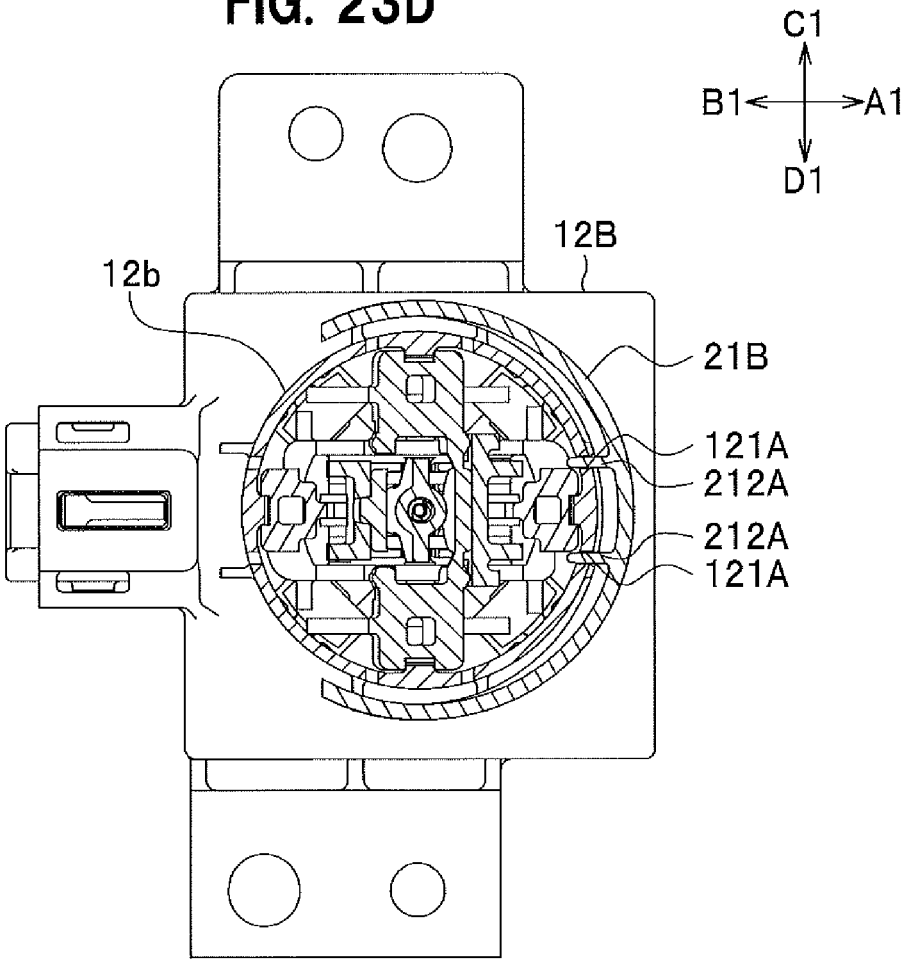
FIG. 23D is a cross-sectional view taken along a line XXIIID-XXIIID in FIG. 23B.

Next, operation of the multifunction switch 1B is described. As shown in FIGS. 23A and 23B, the portion 21*a* of the control cap 21B is pressed downward to swing the control cap 21B toward the direction as indicated by A1. At this time, the positioning plate portions 212A in FIG. 23C are moved downward. At this time, as shown in FIG. 23D, the positioning plate portions 212A are inserted into the associated slit portions 121A and positioned with respect to the cylindrical case 12*b*. This fixes the control cap 21B in posture so as not to be swung in other directions. In contrast, as shown in FIG. 23B, the positioning plate portions 212B are gradually tilted as the positioning plate portions 212A are moved downward, and approach the upper end of the side walls of the slit portions 121B. The upper ends of the side walls of the slit portions 121B are linearly chamfered by the guide walls 121*a*, and therefore the positioning plate portions 212B do not abut on the upper ends of the side walls of the slit portions 121B and do not hinder the control cap 21B from being swung.

Figure 24A:
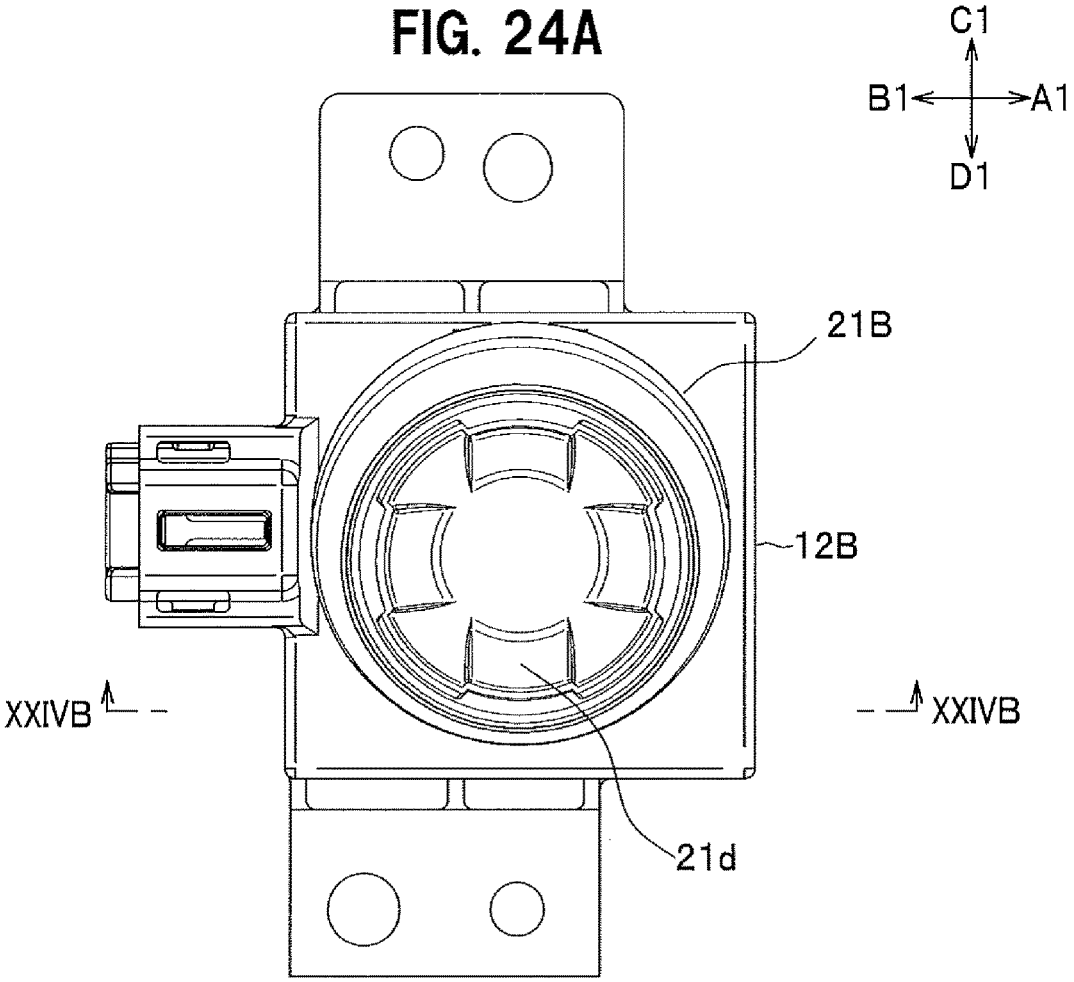
FIG. 24A is a plan view of the multifunction switch having the control cap swung toward the direction indicated by D1.
Figure 24B:
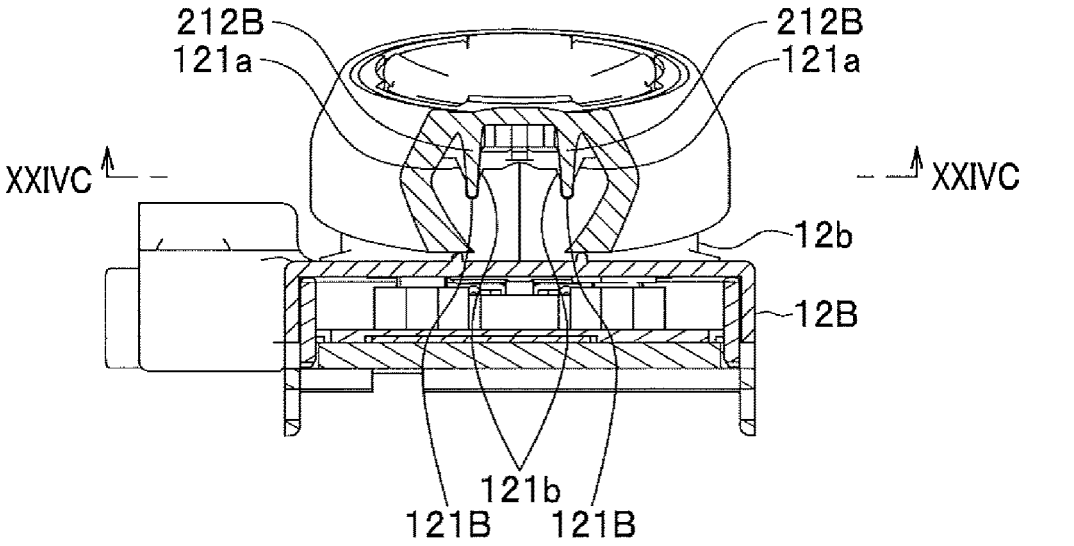
FIG. 24B is a cross-sectional view, taken along a line XXIVB-XXIVB in FIG. 24A, of the multifunction switch having the control cap swung toward the direction indicated by D1.
Figure 24C:
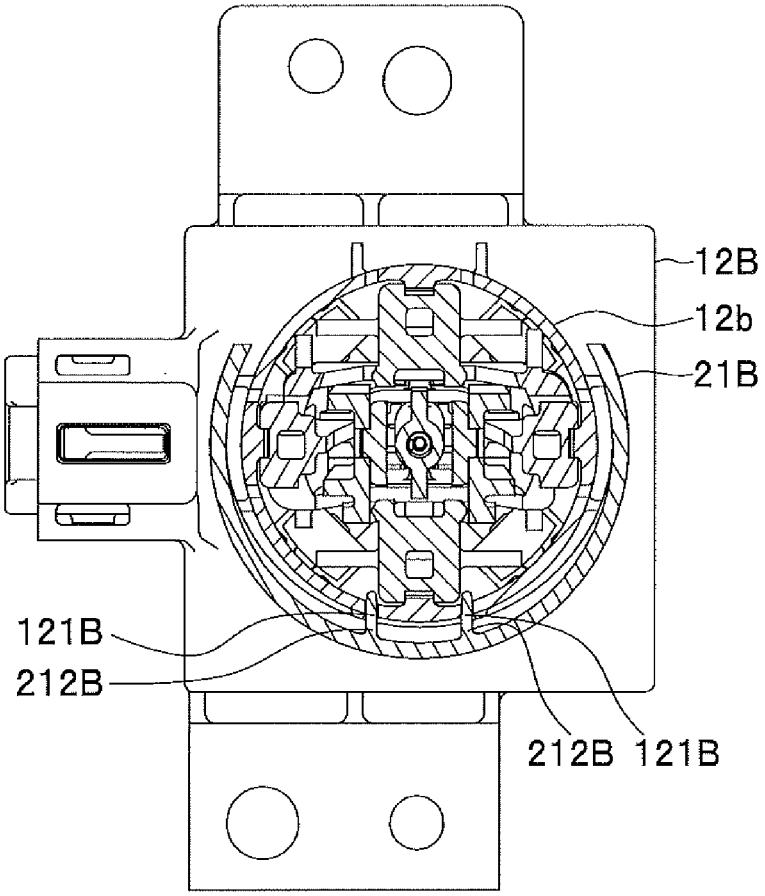
FIG. 24C is a cross-sectional view taken along a line XXIVC-XXIVC in FIG. 24B.

Next, as shown in FIG. 24A, the portion 21*d* of the control cap 21B is pressed down to swing the control cap 21B toward the direction as indicated by D1. At this time, the positioning plate portions 212B are guided by the guide walls 121*a* and 121*b* and directed to the associated slit portions 121B, as shown in FIG. 24B. Then, as shown in FIG. 24C, the positioning plate portions 212B are inserted into the associated slit portions 121B to have the control cap 21B fixed in posture so as not to be swung in other directions.

In the above multifunction switch 1B, the positioning plate portions 212A to 212D are inserted into the associated slit portions 121A to 121D, to have the control cap 21B fixed in posture so as not to be wrongly operated.

LEGEND FOR REFERENCE NUMERALS

1 Multifunction switch; 10 Housing; 11 Basal plate; 12 Case; 13 Contact receiver; 14 Slider guide; 20 Control body; 21 Control cap; 22 Control pin; 23 Coil spring; 30 contact circuit; 31 Movable contact; 32 Fixed contacts; 33 Fulcrum member; 40 Movable mechanism; 41 First movable element; 42 Second movable element; 43A, 43B, 43C, 43D Slider; 44A, 44B, 44C, 44D Driven slider; 121A, 121B, 121C, 121D Slit portion; 212A, 212B, 212C, 212D Positioning plate portion.

I claim:

1. A multifunction switch comprising:

a rotatable control body having a control pin;

a movable contact coining into contact with the control pin; and a movable mechanism including a movable element and at least one support spindle, wherein the movable element has the control pin running therethrough, and wherein the movable element is supported so as to be rotated by the control body about the at least one support spindle which defines a rotation axis of the movable element, wherein the movable contact includes a contact plate configured to be pressed down by the control pin, wherein the contact plate is arranged on one side with respect to the control pin, as viewed in an axial direction of the rotation axis of the movable element, the movable element includes a leg portion extending radially outward, wherein the leg portion is arranged on an opposite rear side from the contact plate with respect to the control pin, as viewed in the axial direction of the rotation axis of the movable element, and when the control body rotates the movable element, the control pin is configured, to be biased to press down the contact plate so that the contact plate comes into contact with a fixed contact, and the leg portion is configured to be moved downward to do mechanical switching for an additional element.

2. The multifunction switch as claimed in claim 1, wherein the movable element is configured to be rotated by the control body in a rotational direction, the contact plate is arranged on a front side with respect to the control pin in the rotational direction, and the leg portion is arranged on an opposite rear side from the contact plate with respect to the control pin in the rotational direction.

3. The multifunction switch as claimed in claim 2, wherein the movable mechanism includes a slider to be moved when pressed by the leg portion.

4. The multifunction switch as claimed in claim 1, wherein the control body is configured to be rotated in a first rotational direction and a second rotational direction which intersect with each other, and the movable element includes:

a first movable element configured to be rotated in the first rotational direction by the control body provided with a guide hole having the control pin running therethrough and configured to guide the control body in the second rotational direction; and a second movable element disposed so as to cross the first movable element, configured to be rotated in the second rotational direction by the control body provided with a guide hole having the control pin miming therethrough and configured to guide the control body in the first rotational direction.

5. The multifunction switch as claimed in claim 4, wherein the second movable element includes a recess in which the first movable element is disposed.

6. The multifunction switch as claimed in claim 1, wherein the movable contact includes a first contact plate, and a second contact plate configured to cross, and integrally formed with, the first contact plate.

7. The multifunction switch as claimed in claim 3, wherein the leg portion is slidably coupled with the slider.

8. The multifunction switch as claimed in claim 1, further comprising:

a case housing the movable element and formed with a slit portion, wherein the control body includes a control cap to house the control pin, wherein the control cap includes a positioning plate portion inserted into the slit portion.

9. The multifunction switch as claimed in claim 8, wherein the slit portion extends from an upper end of the case, and the slit portion includes a guide wall extending obliquely downward from the upper end of the case.

* * * * *